US012612744B2

(12) United States Patent
Hendryx et al.

(10) Patent No.: US 12,612,744 B2
(45) Date of Patent: Apr. 28, 2026

(54) SYSTEM AND METHOD OF OPERATING A VIBRATING SCREED

(71) Applicant: MILWAUKEE ELECTRIC TOOL CORPORATION, Brookfield, WI (US)

(72) Inventors: Caleb Hendryx, Waukesha, WI (US); Joseph C. Reiter, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 620 days.

(21) Appl. No.: 18/155,851

(22) Filed: Jan. 18, 2023

(65) Prior Publication Data

US 2023/0228044 A1 Jul. 20, 2023

Related U.S. Application Data

(60) Provisional application No. 63/300,418, filed on Jan. 18, 2022.

(51) Int. Cl.
*E01C 19/40* (2006.01)
*E04F 21/24* (2006.01)

(52) U.S. Cl.
CPC ..... *E01C 19/402* (2013.01); *E04F 21/242* (2013.01)

(58) Field of Classification Search
CPC ..... E01C 19/402; E04F 21/242
See application file for complete search history.

(56) References Cited

U.S. PATENT DOCUMENTS 2,008,296 A 7/1935 Soldan
2,178,881 A 11/1939 Roeth
2,400,341 A 5/1946 Day et al.
2,411,317 A 11/1946 Day et al.
2,501,158 A 3/1950 Chilcott
2,808,238 A 10/1957 Spitler
3,410,528 A 11/1968 Clark et al.
3,522,740 A 8/1970 Hynes et al.
3,792,617 A 2/1974 Strasser et al.
4,343,568 A 8/1982 Kaltenegger
4,832,525 A 5/1989 Morrison et al.
(Continued)

FOREIGN PATENT DOCUMENTS

KR 200237678 Y1 10/2001

OTHER PUBLICATIONS

MBW, Inc., "ScreeDemon," Operator's Safety and Service Manual, © Dec. 2003 (21 pages).

*Primary Examiner* — Gary S Hartmann
(74) *Attorney, Agent, or Firm* — Michael Best & Friedrich LLP

(57) ABSTRACT

A vibrating screed includes a power unit, a plurality of screed blades, wherein each of the plurality of screed blades is removably engageable with the power unit one at a time. The vibrating screed further includes a power unit controller operably coupled to the power unit, a memory operably coupled to the power unit controller, and a blade selector operably coupled to the power unit controller. The power unit controller is operable to receive a blade selection from the blade selector, the blade selection indicating a size of a particular screed blade within the plurality of screed blades; retrieve a range of operating speeds associated with the blade selection; and set the operational speed of the vibrating screed to correspond to the range of operating speeds associated with the blade selection.

20 Claims, 19 Drawing Sheets

(56) References Cited

U.S. PATENT DOCUMENTS

| | | | | |
|---|---|---|---|---|
| 5,984,571 | A | 11/1999 | Owens | |
| 6,231,331 | B1 | 5/2001 | Lievers | |
| 6,296,467 | B1 | 10/2001 | Rouillard | |
| 6,988,851 | B2 | 1/2006 | Sina | |
| 7,175,365 | B1 | 2/2007 | Breeding | |
| 7,201,537 | B2 | 4/2007 | Sina | |
| 7,204,659 | B2 | 4/2007 | Schmitt et al. | |
| 7,320,558 | B2 * | 1/2008 | Quenzi | E04F 21/244 404/114 |
| 7,549,822 | B2 | 6/2009 | Rouillard | |
| 7,572,082 | B2 | 8/2009 | Rouillard | |
| 12,084,873 | B2 * | 9/2024 | Reiter | E01C 19/40 |
| 12,247,361 | B2 * | 3/2025 | Baratta | E04F 21/242 |
| 2017/0218576 | A1 * | 8/2017 | Lindley | E01C 19/402 |
| 2019/0006980 | A1 | 1/2019 | Sheeks et al. | |

* cited by examiner

SYSTEM AND METHOD OF OPERATING A VIBRATING SCREED

CROSS-REFERENCE TO RELATED APPLICATIONS

This application claims priority to U.S. Provisional Patent Application No. 63/300,418 filed on Jan. 18, 2022, the entire content of which is incorporated herein by reference.

FIELD OF THE DISCLOSURE

The present invention relates to screeds for leveling concrete, and more particularly to vibrating screeds.

BACKGROUND OF THE DISCLOSURE

Vibrating screeds include a blade and a vibration mechanism to impart vibration to the blade to facilitate smoothing and leveling a poured viscous material, such as concrete.

SUMMARY OF THE DISCLOSURE

The present disclosure provides, in one aspect, a vibrating screed that includes a power unit; a plurality of screed blades, wherein each of the plurality of screed blades is removably engageable with the power unit one at a time; a power unit controller operably coupled to the power unit; a memory operably coupled to the power unit controller; and a blade selector operably coupled to the power unit controller, wherein the power unit controller is operable to: receive a blade selection from the blade selector, the blade selection indicating a size of a particular screed blade within the plurality of screed blades; retrieve a range of operating speeds associated with the blade selection; and set the operational speed of the vibrating screed to correspond to the range of operating speeds associated with the blade selection.

The present disclosure provides, in another aspect, a vibrating screed that includes a power unit; a plurality of screed blades, wherein each of the plurality of screed blades is removably engageable with the power unit one at a time; a power unit controller operably coupled to the power unit, wherein the power unit controller is operable to: monitor a blade selector for a selected screed blade size; retrieve one or more operating speeds associated with the selected screed blade size; and set a throttle coupled to the power unit to the one or more operating speeds associated with the selected screed blade size.

The present disclosure provides, in still another aspect, a method of operating a vibrating screed that includes receiving a selected screed blade size from a blade selector; retrieving a range of operating speeds associated with the selected screed blade size; and setting an operational speed of the vibrating screed to correspond to the range of operating speeds associated with the selected screed blade size.

Other features and aspects of the disclosure will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
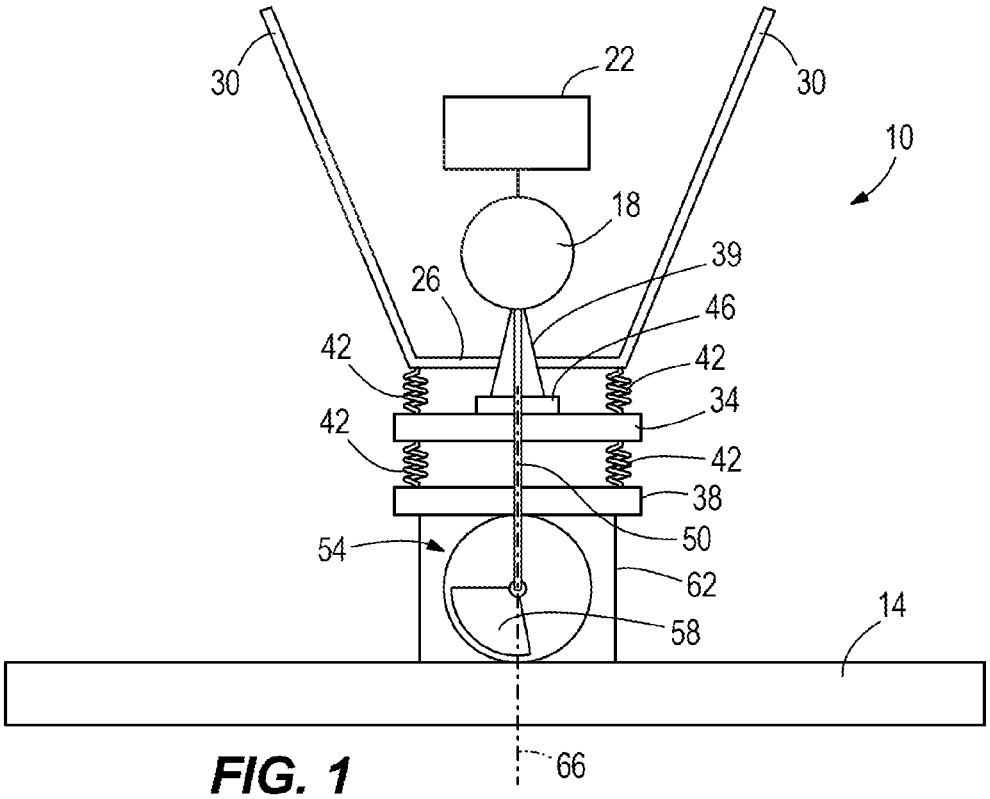
FIG. 1 is a schematic view of a vibrating screed.

As shown in FIG. 1, a vibrating screed 10 includes a screed member 14, such as bar or blade, for smoothing and leveling a viscous material, such as concrete. The vibrating screed 10 also includes an electric motor 18, a battery pack 22 (i.e., a power source) for powering the motor 18, and a frame 26 upon which the motor 18 and battery pack 22 are supported. The frame 26 includes a pair of handles 30, a first platform 34 on which the motor 18 and a drive housing 38 is arranged, and a second platform 38 below which the screed member 14 is arranged. In some constructions, the battery pack 22 and the motor 18 can be configured as an 80 Volt high power battery pack and motor, such as the 80 Volt battery pack and motor disclosed in U.S. patent application Ser. No. 16/025,491 filed on Jul. 2, 2018 (now U.S. Patent Application Publication No. 2019/0006980), the entirety of which is incorporated herein by reference. In such a battery pack 22, the battery cells within the battery pack 22 have a nominal voltage of up to about 80 V. In some embodiments, the battery pack 22 has a weight of up to about 6 lb. In some embodiments, each of the battery cells has a diameter of up to 21 mm and a length of up to about 71 mm. In some embodiments, the battery pack 22 includes up to twenty battery cells. In some embodiments, the battery cells are connected in series. In some embodiments, the battery cells are operable to output a sustained operating discharge current of between about 40 A and about 60 A. In some embodiments, each of the battery cells has a capacity of between about 3.0 Ah and about 5.0 Ah. And, in some embodiments of the motor 18 when used with the 80 Volt battery pack 22, the motor 18 is a high-power output motor having a power output of at least about 2760 W and a nominal outer diameter (measured at the stator) of up to about 80 mm. In alternative embodiments, the battery pack 22 may power a motor 18 which has a power output other than (i.e., less than or greater than) 2760 W. In alternative embodiments, instead of an electric motor and a battery pack, a gas engine may be used.

With continued reference to FIG. 1, to attenuate vibration transmitted to the operator, the motor 18, and battery pack 22, vibration dampers 42 are arranged between the first and second platforms 34, 38, as well as the first platform 34 and the handles 30. Another vibration damper 46 is arranged between the drive housing 38 and the first platform 34 and the drive housing 38. A flexible driveshaft 50 transmits torque from the motor 18 to an exciter assembly 54 that is configured to vibrate the screed member 14. The exciter assembly 54 includes an eccentric mass 58 that is coupled for rotation with the driveshaft 50 and arranged in an exciter housing 62 that is coupled to the screed member 14. In response to the motor 18 rotating the driveshaft 50, the eccentric mass 58 rotates about a rotational axis 66 defined by the driveshaft 50, causing a rotating unbalance that transmits vibration through the exciter housing 62 to the screed member 14, thus causing the screed member 14 to vibrate in a direction parallel with the axis 66.

Figure 2:
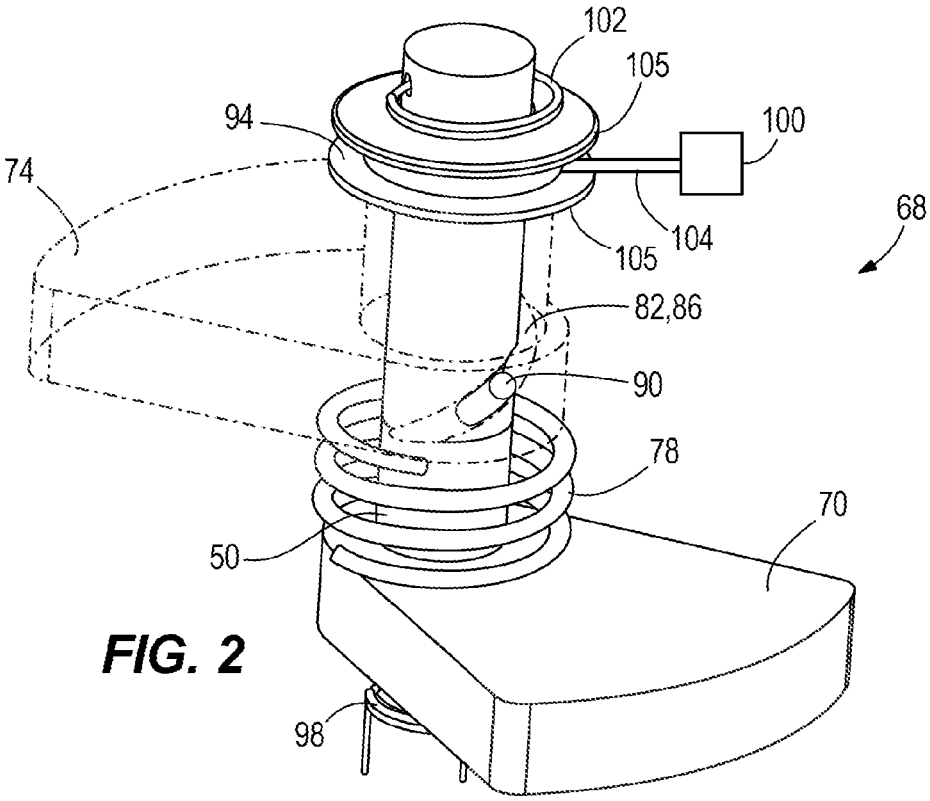
FIG. 2 is a perspective view of an exciter assembly for use with the vibrating screed of FIG. 1, with a second eccentric mass in a first position.
Figure 4:
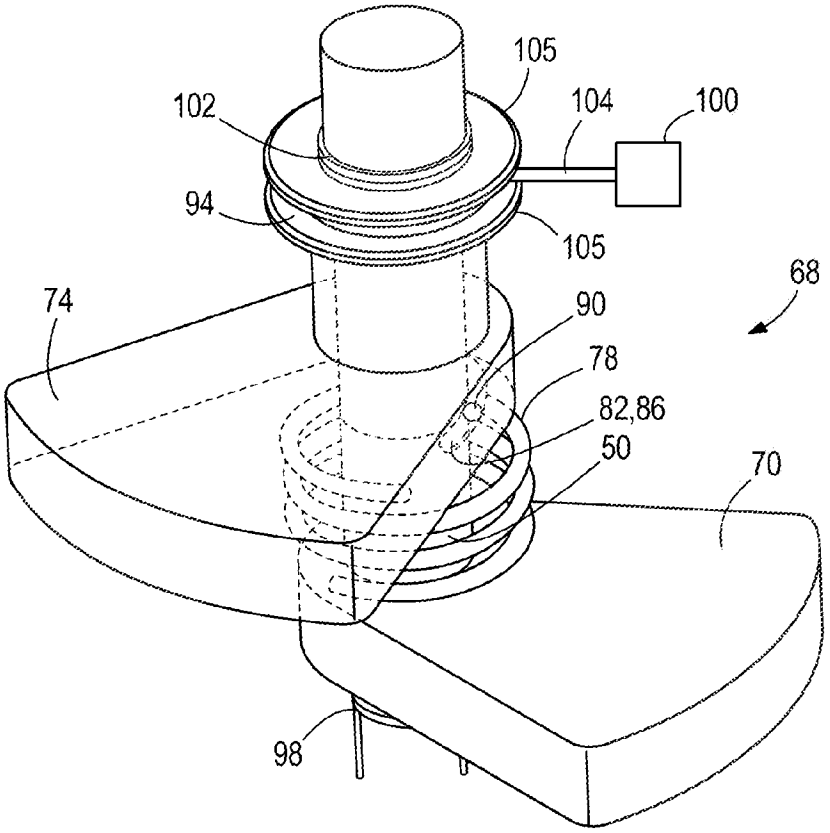
FIG. 4 is a perspective view of the exciter assembly of FIG. 2, with a second eccentric mass in a second position.
Figure 3:
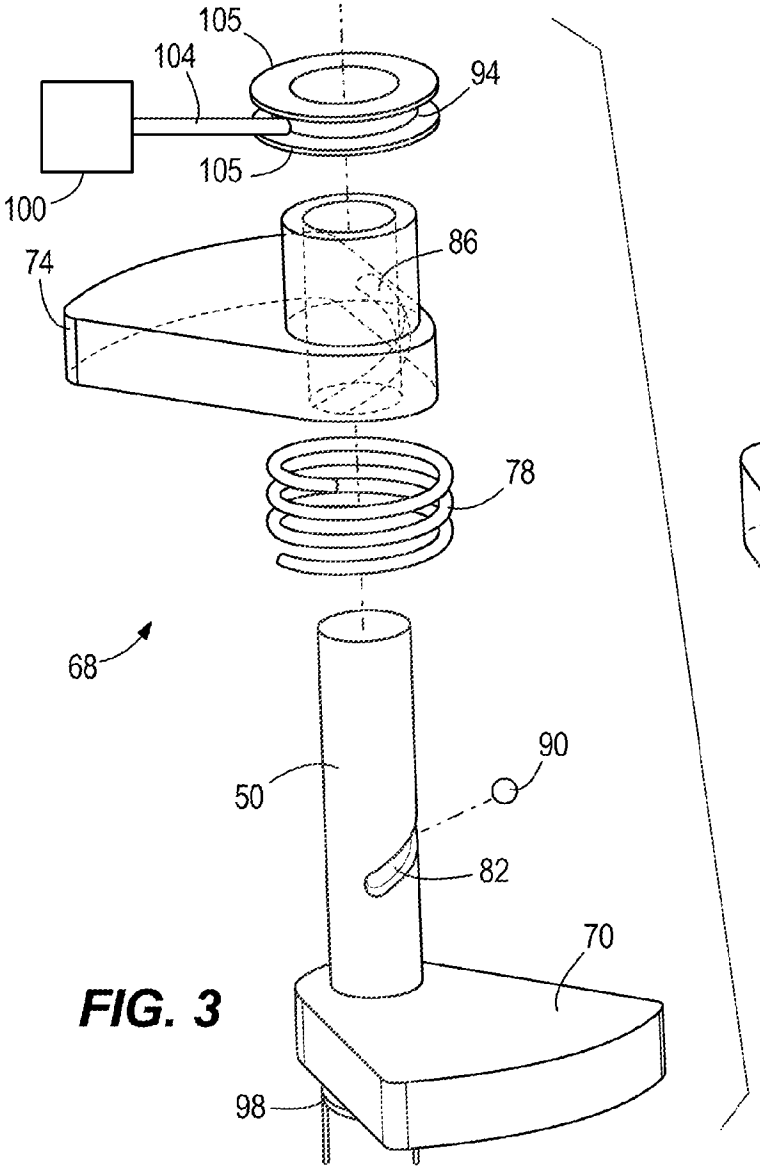
FIG. 3 is an exploded view of the exciter assembly of FIG. 2.

As shown in FIGS. 2-4, an embodiment of an exciter assembly 68 is shown that may be used with the vibrating screed 10 and arranged within the exciter housing 62, instead of the exciter assembly 54. The exciter assembly 68 includes a first eccentric mass 70 that is fixed on the driveshaft 50 and a second eccentric mass 74 that is moveable along the driveshaft 50, as described in further detail below. A spring 78 is arranged on the driveshaft 50 and seated on the first eccentric mass 70 to bias the second eccentric mass 74 away from the first eccentric mass 70. The driveshaft 50 includes an exterior helical groove 82, the second eccentric mass 74 includes an internal helical groove 86, and a ball 90 is arranged within and between the exterior and internal helical grooves 82, 86. A shift collar 94 is arranged on the driveshaft 50 adjacent the second eccentric mass 74 on a side of the second eccentric mass 74 opposite the first eccentric mass 70. A first bearing 98 rotatably supports the driveshaft 50 beneath the first eccentric mass 74 and a second bearing 102 rotatably supports the driveshaft 50 above the shift collar 94.

In operation of the exciter assembly 68 of FIGS. 2-4, the exciter assembly 68, in its default state, is in a first, low vibration mode shown in FIG. 2. In the low vibration mode of the exciter assembly 68, the spring 78 biases the second eccentric mass 74 upward against the shift collar 94 to a first position in which the second eccentric mass 74 is oriented 180 degrees about the driveshaft 50 from the first eccentric mass 70. Specifically, the angular position of the second eccentric mass 74 about the driveshaft 50 is dictated by the position of the ball 90 in the internal helical groove 86. When the motor 18 is activated while the exciter assembly 68 is in the first, low vibration mode, the first and second eccentric masses 70, 74 rotate with the driveshaft 50, creating vibration that is transferred through the exciter housing 62 to the screed member 14. However, because the first and second eccentric masses 70, 74 are 180 degrees from one another about the driveshaft 50, the first and second eccentric masses 70, 74 act as counterweights to one another, thus reducing the rotating unbalance of the driveshaft 50, and thus the amplitude of vibration created by the exciter assembly 68.

If the operator desires to increase the magnitude of vibration transferred to the screed member 14, the operator manipulates a mode selector 100, such as a knob or sliding actuator, on the exterior of the exciter housing 62. The mode selector 100 is operably coupled to the shift collar 94 via a shift pin 104 arranged between parallel flanges 105 of the shift collar 94. Manipulation of the mode selector 100 causes the shift collar 94, and thus the second eccentric mass 74, to move towards the first eccentric mass 70 along the driveshaft 50 to a second position (FIG. 4), corresponding to a second, high vibration mode of the exciter assembly 68. As the second eccentric mass 74 moves toward the driveshaft 50, the second eccentric mass 74 also rotates about the driveshaft 50, due to its angular position being dictated by the position of the ball 90 in the internal helical groove 86. Then, when the motor 18 is activated, because the second eccentric mass 74 is closer to being rotationally aligned, or is substantially rotationally aligned, with the first eccentric mass 70 on the driveshaft 50, the rotating unbalance of the driveshaft 50 increases, thus increasing the magnitude of vibration created by the exciter assembly 68 relative to the first, low vibration mode of the exciter assembly 68.

If the operator thereafter wants to adjust the exciter assembly 68 back to the first, low vibration mode, the operator manipulates the mode selector 100, shifting the shift collar 94 away from the first eccentric mass 70, thus allowing the spring 78 to bias the second eccentric mass 74 back to the first position shown in FIG. 2 corresponding to the first, low vibration mode of the exciter assembly 68. In some embodiments, the shift collar 94 is moveable by the mode selector 100 while the motor 18 is activated, and in other embodiments, the shift collar 94 is only moveable prior to operation, then locked in position prior to activation of the motor 18.

Figure 5:
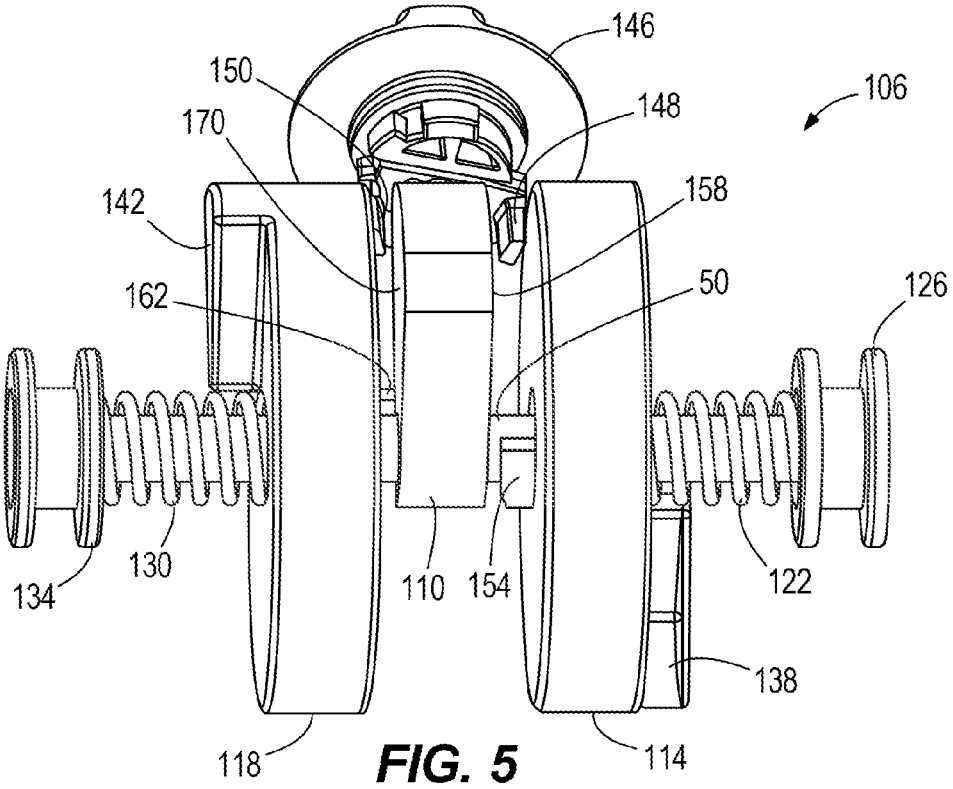
FIG. 5 is a perspective view of another exciter assembly for use with the vibrating screed of FIG. 1, with the exciter assembly in a second, medium vibration mode.
Figure 6:
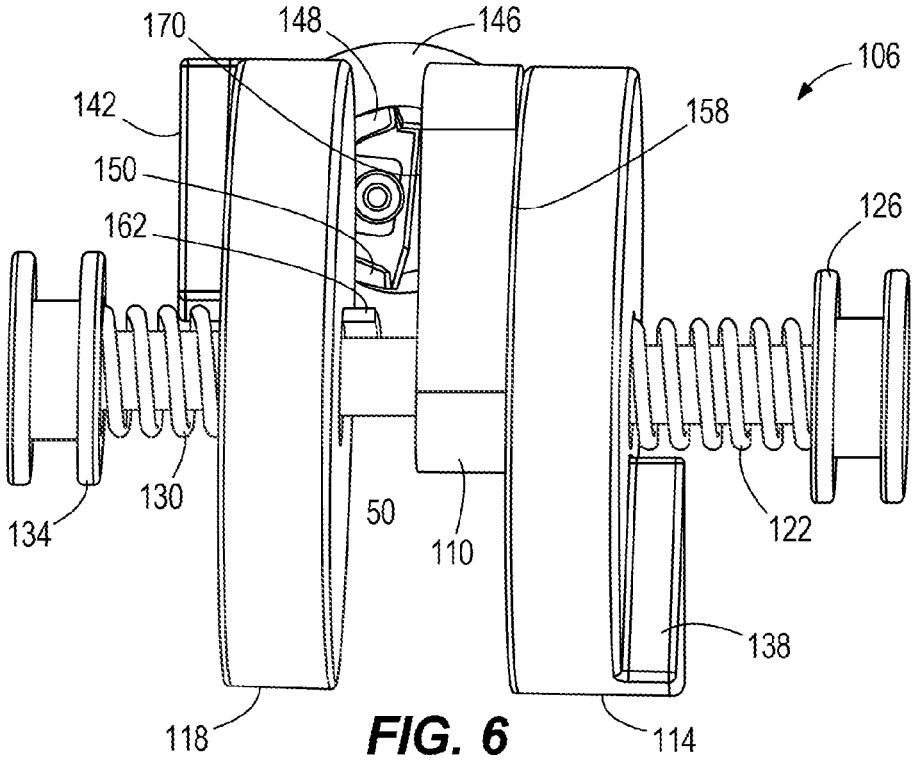
FIG. 6 is a perspective view of the exciter assembly of FIG. 5, with the exciter assembly in a first, low vibration mode.
Figure 7:
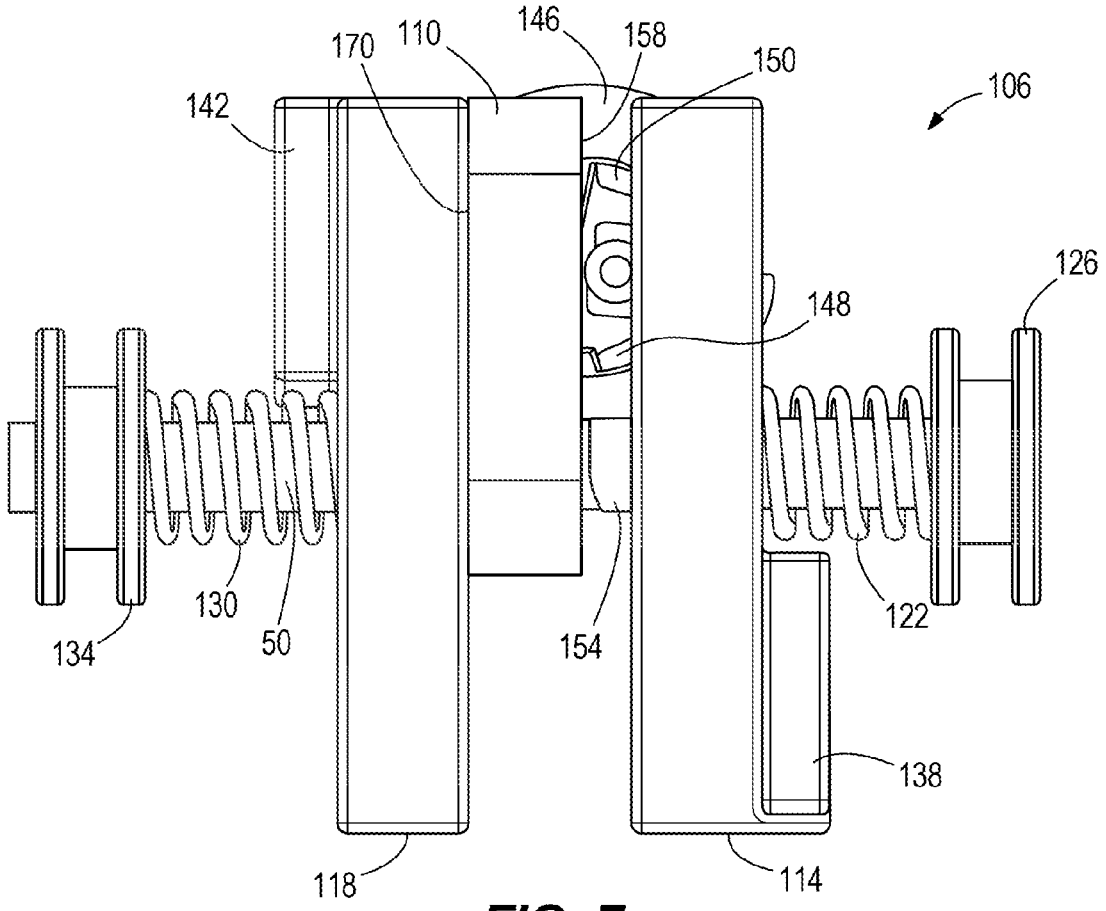
FIG. 7 is a perspective view of the exciter assembly of FIG. 5, with the exciter assembly in a third, high vibration mode.

As shown in FIGS. 5-7, another embodiment of an exciter assembly 106 is shown for use with the vibrating screed 10 and arranged within the exciter housing 62, instead of the exciter assembly 54 or the exciter assembly 68. The exciter assembly 106 includes a first eccentric mass 110 that is fixed on the driveshaft 50, a second eccentric mass 114 that is neither axially nor rotationally fixed to the driveshaft 50, and a third eccentric mass 118 that is also neither axially nor rotationally fixed with respect to the driveshaft 50, as described in further detail below. A first spring 122 is arranged on the driveshaft 50 and seated on a first thrust collar 126 to bias the second eccentric mass 114 toward the first eccentric mass 110. A second spring 130 is arranged on the driveshaft 50 and seated on a second thrust collar 134 to bias the third eccentric mass 118 toward the first eccentric mass 110.

The second eccentric mass 114 includes an eccentric weight portion 138 and the third eccentric mass 118 also includes an eccentric weight portion 142. A mode selector, such as knob 146 on the exterior of the exciter housing 62, includes a first arm 148 and a second arm 150 that are engageable, respectively or simultaneously, with the second and third eccentric masses 114, 118, as explained in further detail below.

Figure 8:
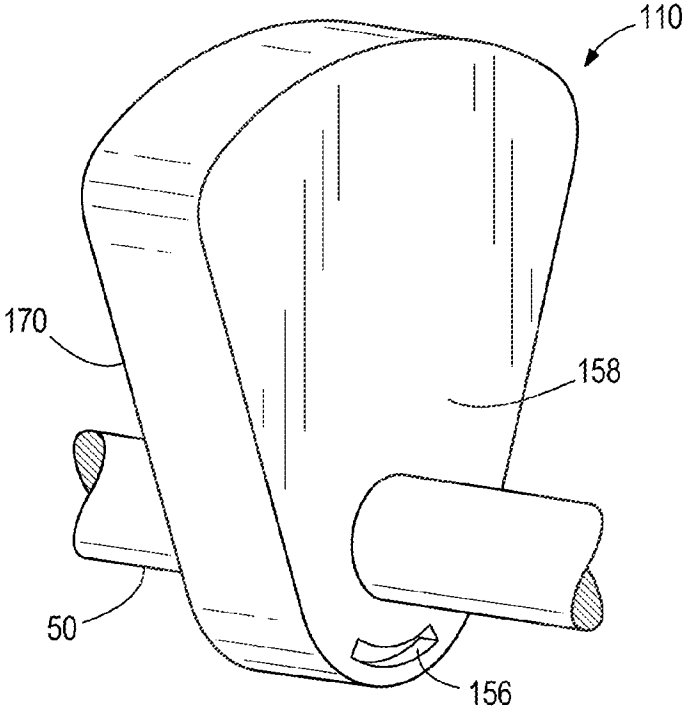
FIG. 8 is a perspective view of a first side of a first eccentric mass of the exciter assembly of FIG. 5.

As shown in FIGS. 5 and 8, the second eccentric mass 114 includes a clutch member 154 that is configured to be received in a first recess 156 on a first face 158 of the first eccentric mass 110 that is in facing relationship with the second eccentric mass 114. The first recess 156 is rotationally positioned on the first face 158 and the clutch member 154 is rotationally positioned on the second eccentric mass 114 such that when the clutch member 154 is received in the first recess 156, the second eccentric mass 114 becomes locked for rotation with the first eccentric mass 110 with the driveshaft 50, and the eccentric weight portion 138 of the second eccentric mass 114 is arranged 180 degrees about the driveshaft 50 from the first eccentric mass 110.

Figure 9:
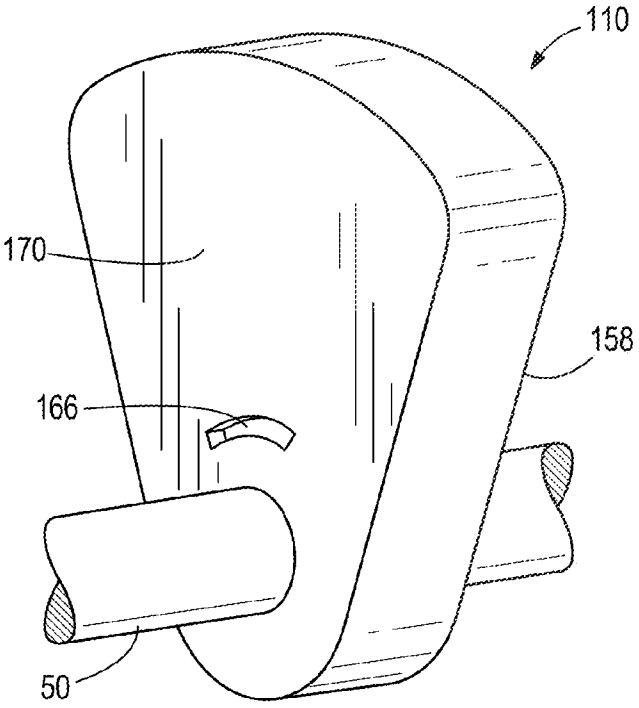
FIG. 9 is a perspective view of a second side of a first eccentric mass of the exciter assembly of FIG. 5.

As shown in FIGS. 5 and 9, the third eccentric mass 118 includes a clutch member 162 that is configured to be received in a second recess 166 on a second face 170 of the first eccentric mass 110 that is in facing relationship with the third eccentric mass 118. The second face 170 of the first eccentric mass 110 is opposite the first face 158. The second recess 166 is rotationally positioned on the second face 170 and the clutch member 162 is rotationally positioned on the third eccentric mass 118, such that when the clutch member 162 is received in the second recess 166, the third eccentric mass 118 becomes locked for rotation with the first eccentric mass 110 with the driveshaft 50, and the eccentric weight portion 142 of the third eccentric mass 118 is rotationally aligned with the first eccentric mass 110 on the driveshaft 50.

In operation of the exciter assembly 106 of FIGS. 5-7, the knob 146 is moveable to a first position (FIG. 6), in which the knob 146 is rotated such that both of the first and second arms 148, 150 only engage the third eccentric mass 118, thus putting the exciter assembly 106 in a first, low vibration mode. Because neither of the first and second arms 148, 150 block the second eccentric mass 114, it is biased toward the first eccentric mass 110 by the first spring 122, such that when the clutch member 154 is received in the first recess 156, the second eccentric mass 114 becomes locked for rotation with the first eccentric mass 110 with the driveshaft 50, and the eccentric weight portion 138 of the second eccentric mass 114 is arranged 180 degrees about the driveshaft 50 from the first eccentric mass 110, as shown in FIG. 6. Thus, when the exciter assembly 106 is operated in the first, low vibration mode, because the second eccentric mass 114 is locked for rotation with the first eccentric mass 110 on the driveshaft 50, and because the eccentric weight portion of the second eccentric mass 114 is rotationally offset by 180 degrees from the first eccentric mass 110, the first and second eccentric masses 110, 114 act as counterweights to one another as they rotate together about the driveshaft 50, thus reducing the rotating unbalance of the driveshaft 50, and thus the magnitude of vibration of the exciter assembly 106. As co-rotation of the first and second eccentric masses 110, 114 occurs, the third eccentric mass 118 does not rotate with the driveshaft 50 because it is blocked from mating with the first eccentric mass 110 by the arms 148, 150. Therefore, the third eccentric mass 118 remains stationary while the driveshaft 50 and the first and second eccentric masses 110, 114 co-rotate.

If the operator desires to increase vibration of the exciter assembly 106, the knob 146 is moveable to a second position (FIG. 5), in which the knob 146 is rotated such that the first arm 148 engages the second eccentric mass 114, and the second arm 150 engages the third eccentric mass 118, thus putting the exciter assembly 106 in a second, medium vibration mode. In the second, medium vibration mode, the second and third eccentric masses 114, 118 are respectively blocked by the first and second arms 148, 150 from axially mating against the first eccentric mass 110, such that neither of the first and second eccentric masses 114, 118 is mated for rotation with the first eccentric mass 110 or the driveshaft 50. Thus, when the exciter assembly 106 is operated in the second, medium vibration mode, because the first eccentric mass 110 is not rotationally mated with the second eccentric mass 114, neither the second nor the third eccentric masses 114, 118 are able to act as counterweights to one another (as in the first, low vibration mode). As such, the rotating unbalance of the driveshaft 50 and a magnitude of vibration of the exciter assembly 106 is increased relative to the first, low vibration mode.

If the operator desires to further increase vibration of the exciter assembly 106, the knob 146 is moveable to a third position (FIG. 7), in which the knob 146 is rotated such that both of the first and second arms 148, 150 only engage the second eccentric mass 114, thus putting the exciter assembly 106 in a third, high vibration mode. Because neither of the first and second arms 148, 150 block the third eccentric mass 118, the third eccentric mass 118 is biased toward the first eccentric mass 110 by the second spring 130, such that when the clutch member 162 is received in the second recess 166, the third eccentric mass 118 becomes locked for rotation with the first eccentric mass 110 on the driveshaft 50, and the eccentric weight portion 142 of the third eccentric mass 118 is rotationally aligned with the first eccentric mass 110 on the driveshaft 50, as shown in FIG. 6. Thus, when the exciter assembly 106 is operated in the third, high vibration mode, because the third eccentric mass 118 is locked for rotation with the first eccentric mass 110 on the driveshaft 50, and because the eccentric weight portion 142 of the third eccentric mass 118 is rotationally aligned with the first eccentric mass 110, the unbalance on the driveshaft 50 is increased as compared to when the third eccentric mass 118 is spaced from and not rotatable with the first eccentric mass 110. Thus, the rotating unbalance of the driveshaft 50 and the magnitude of vibration of the exciter assembly 106 is increased relative to the first and second modes. As co-rotation of the first and third eccentric masses 110, 118 occurs, the second eccentric mass 114 does not rotate with the driveshaft 50 because it is blocked from mating with the first eccentric mas 110 by the arms 148, 150. Therefore, the second eccentric mass 114 remains stationary while the driveshaft 50 and masses 110, 118 co-rotate.

Typical vibrating screeds limit or do not give the operator the ability to adjust the magnitude of vibration that is delivered to the screed member 14, independent of adjusting the speed of the motor 18 (and thus the frequency, but not magnitude, of vibration). Even if the operator can change the magnitude of vibration on typical vibrating screeds, such magnitude changes involve manually removing a nut or bolt from the driveshaft to adjust the position of the eccentric mass to a desired position, which is time consuming, difficult, and can undesirably expose the exciter assembly to concrete.

In contrast to typical vibrating screeds, the exciter assemblies 68, 106 are both arranged in the sealed exciter housing 62 and changing the magnitude of vibration delivered to the screed member 14 is as simple as adjusting the mode selection members 146. This allows the operator to quickly and efficiently change vibration modes for new pour conditions in a screed operation, while simultaneously providing better protection to the exciter assemblies 68, 106, thus increasing their longevity.

Figure 10:
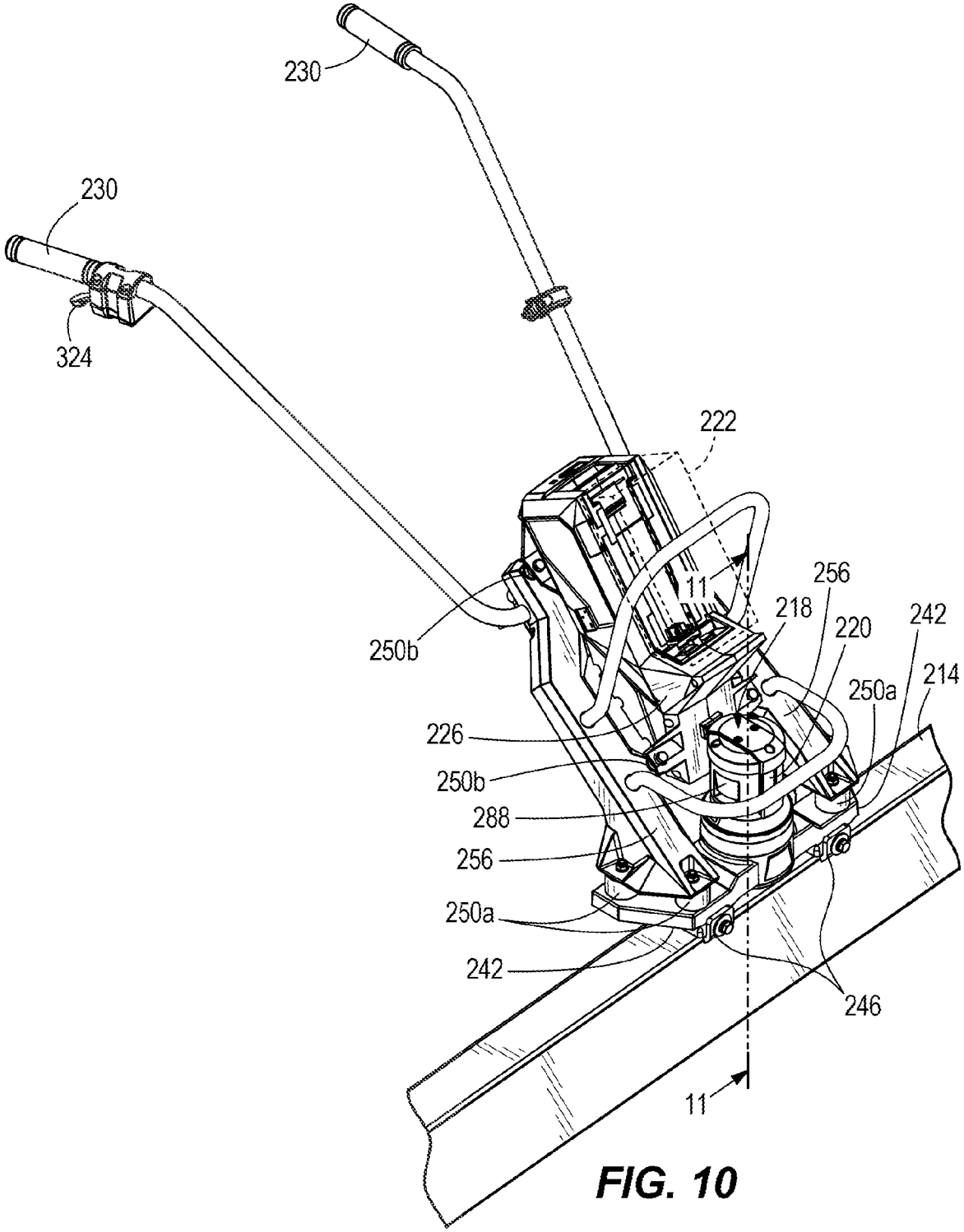
FIG. 10 is a perspective view of a vibrating screed according to another embodiment.
Figure 11:
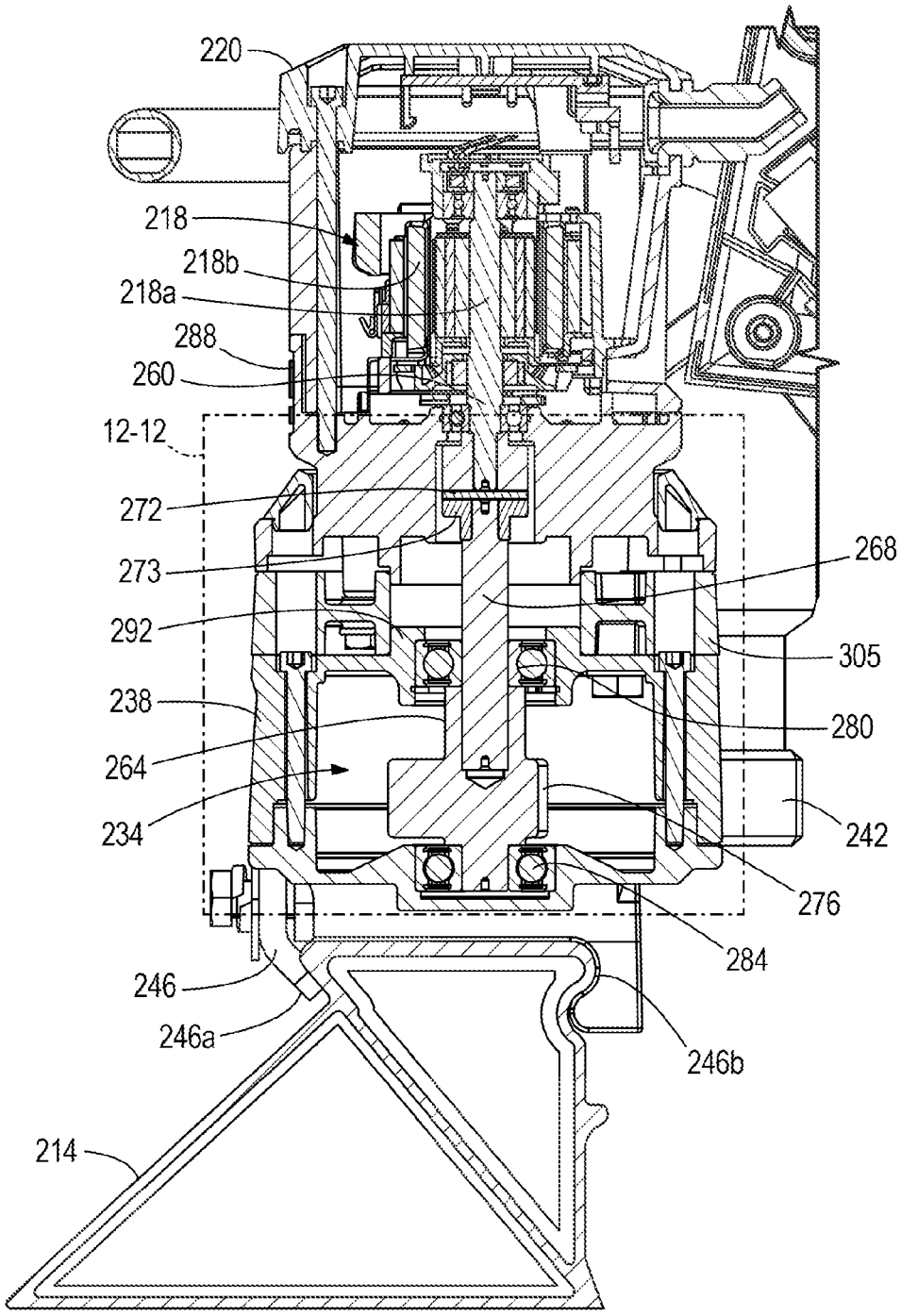
FIG. 11 is a cross-sectional view of the vibrating screed taken along line 11-11 in FIG. 10.
Figure 12:
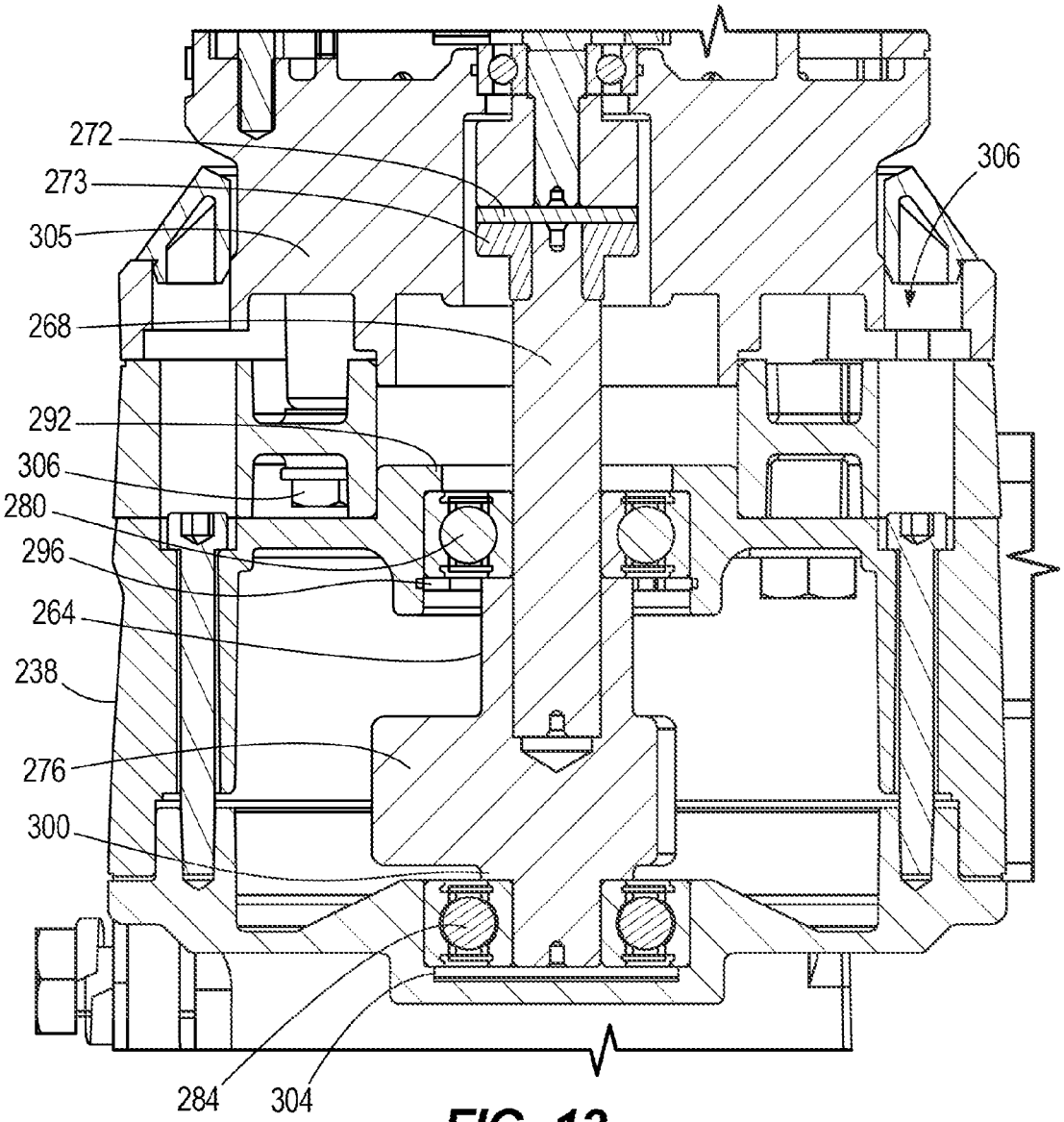
FIG. 12 is an enlarged cross-sectional view of the vibrating screed taken along line 12-12 in FIG. 11.

FIGS. 10-12 illustrate a vibrating screed 210 according to another embodiment. The vibrating screed 210 may include features similar to the vibrating screed 10 discussed above. Conversely, features of the vibrating screed 210 may apply to the vibrating screed 10 discussed above. As shown in FIG. 10, the vibrating screed 210 includes a screed blade 214 for smoothing and leveling a viscous material, such as concrete. The vibrating screed 210 also includes a brushless DC (BLDC) electric motor 218 within a motor housing 220, a battery pack 222 for powering the motor 218, and a housing 226 within which control electronics associated with the motor 218 (e.g., one or more of the electronic processor 308, memory 312, power switching network 316, and/or memory 328) are located and upon which the battery pack 222 is supported. The motor 218 includes a rotor 218*a* and a stator 218*b* (FIG. 11). The screed 210 also includes a pair of handles 230 (FIG. 10) extending from a frame 256 that are grasped by a user for maneuvering the screed 210 around a work site.

The motor 218 is configured to drive an exciter assembly 234 including an exciter housing 238 (FIG. 11). The exciter housing 238 includes a pair of wings 242 (FIG. 10) extending parallel with the screed blade 214. Each wing 242 includes a clamp 246 (FIG. 11) fastened thereto to clamp onto the screed blade 214 and secure the screed blade 214 to the exciter housing 238. In some embodiments, the clamp 246 may be configured as a quick release mechanism including, for example, an over-center cam latch. As illustrated in FIG. 11, each of the clamps 246 includes an edge clamp 246*a*, which is fastened to an associated wing 242, and a compatible interface 246*b*, which is integrally formed with the associated wing 242 of the exciter housing 238. The interface 246*b* is shaped to be compatible with various screed blades 214. The clamp 246 may be another mechanism operable to secure the screed blade 214 to the wing 242.

Figure 10A:
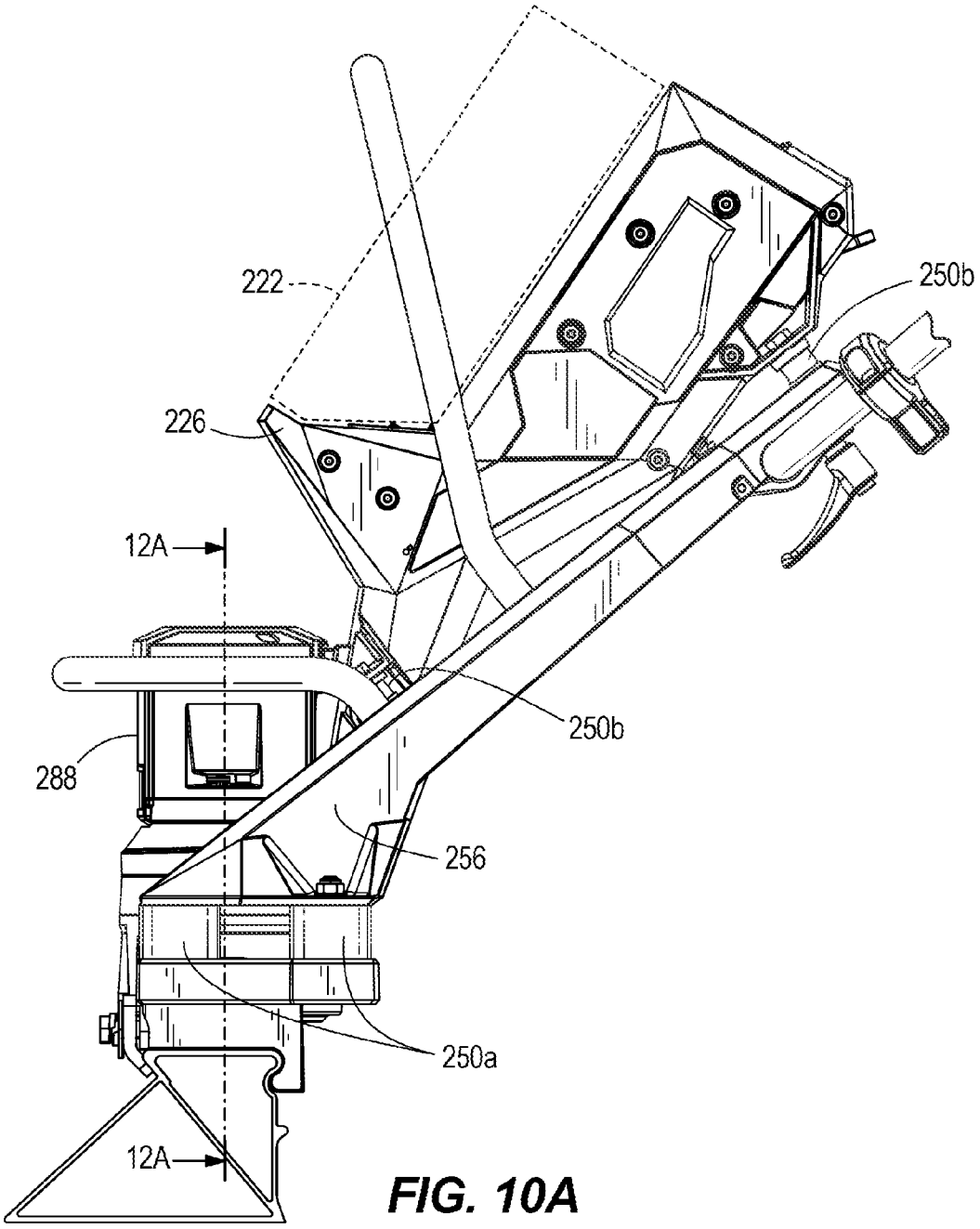
FIG. 10A is a side view of the vibrating screed of FIG. 10.

As shown in FIGS. 10 and 10A, to attenuate vibration transmitted to the operator, the control electronics within the housing 226, and the battery pack 222, vibration dampers 250*a* (e.g., visco-elastic bushings or a spring-damper unit) are arranged between each of the wings 242 and the frame 256. Additionally, vibration dampers 250*b* (e.g., visco-elastic bushings or a spring-damper unit) are arranged between the frame 256 and the housing 226. In the illustrated embodiment of the vibrating screed 210, four vibration dampers 250*a* are cylindrically shaped and are provided in a rectangular array (as viewed from above) between the frame 256 and the exciter housing 238. And, in the illustrated embodiment of the vibrating screed 210, four vibration dampers 250*b* are cylindrically shaped and are provided in a rectangular array (as viewed in a direction perpendicular to the frame 256) between the frame 256 and the housing 226. The vibration dampers 250*a*, 250*b* are also symmetrically located relative to a vertical plane (co-planar with section 11-11 in FIG. 10) bisecting the housing 226 and the motor 218.

As shown in FIG. 11, a driveshaft 260 receives torque from the motor 218 and transmits the torque to an exciter shaft 264 of the exciter assembly 234 via an intermediate shaft 268 and an elastomeric coupler 272. The exciter shaft 264 includes an eccentric mass 276 and is rotatably supported within the exciter housing 238 by first and second bearings 280, 284. A motor cap 288 is arranged on the motor housing 220 and covers the driveshaft 260 by extending over a neck 292 of the exciter housing 238. In response to the motor 218 rotating the driveshaft 260, the eccentric mass 276 rotates, causing a rotating imbalance that transmits vibration through the exciter housing 238 to the screed blade 214, thus causing the screed blade 214 to vibrate in a direction perpendicular to the exciter shaft 264.

Figure 12A:
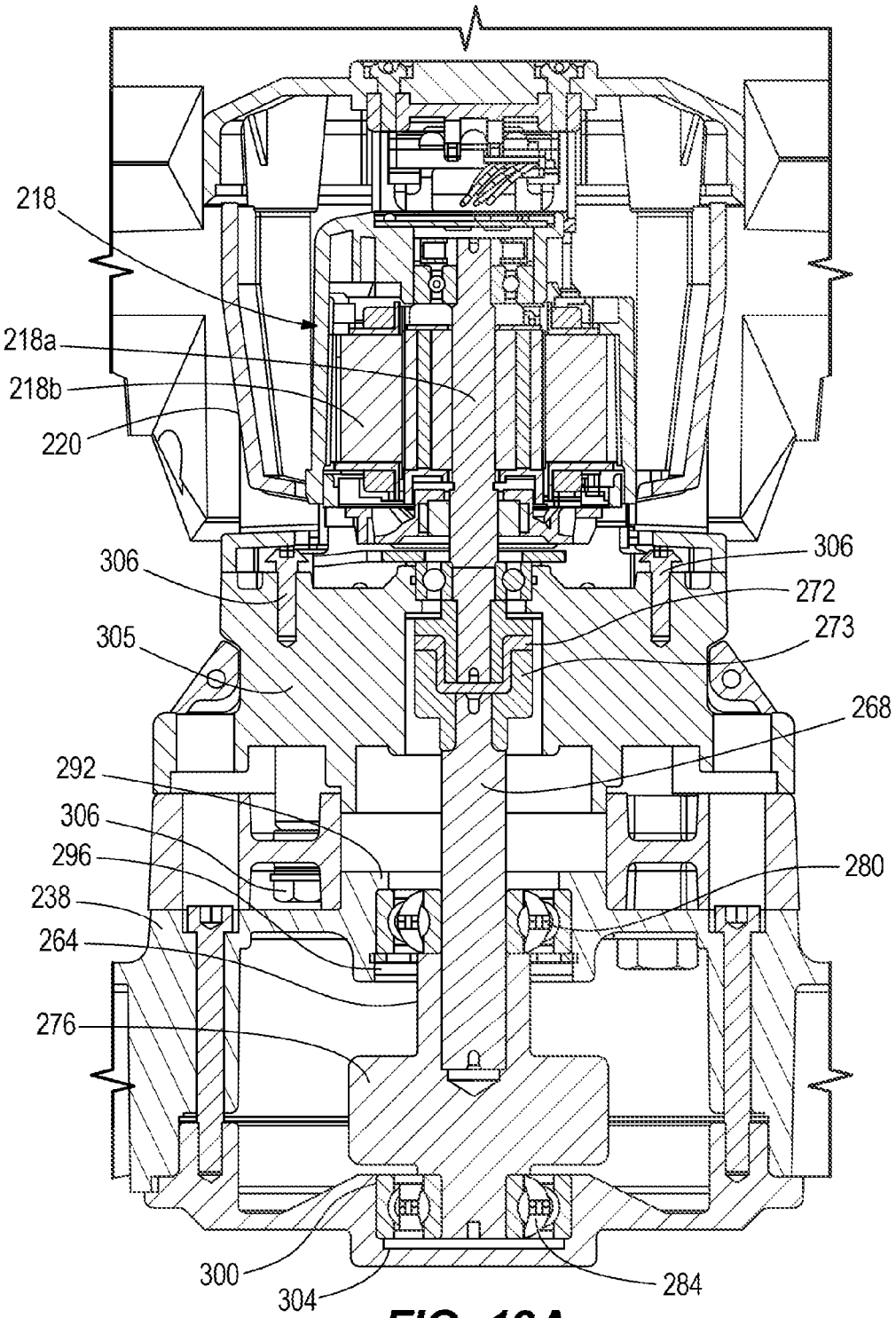
FIG. 12A is a cross-sectional view of the vibrating screed taken along line 12A-12A in FIG. 10A.

As shown in FIG. 12, the first bearing 280 is arranged between the neck 292 of the exciter housing 238 and a retaining ring 296 set in the exciter housing 238. The second bearing 284 is arranged between larger diameter portion 300 of the exciter shaft 264, and a lower ledge 304 of the exciter housing 238. As shown in FIG. 12A, both exciter housing 238 and the motor housing 220 are fixedly secured to an intermediate housing 305 by a number of fasteners 306. At least one fastener 306 secures the exciter housing 238 to the intermediate housing 305. At least one fastener 306 secures the motor housing 220 to the intermediate housing 305. And, the exciter housing 238 is rigidly connected to the wings 242 which, in turn, are rigidly connected to the screed blade 214 via the clamps 246. As such, vibration created by the rotating eccentric mass 276 is transmitted through the exciter housing 238 and the wings 242 without attenuation. The elastomeric coupler 272 is located within the intermediate housing 305. In the illustrated embodiment, the elastomeric coupler 272 is formed of plastic. The elastomeric coupler 272 provides inline isolation of vibration generated by the eccentric mass 276 to inhibit damage to the motor 218. The illustrated elastomeric coupler 272 engages a secondary coupler 273 and the rotor 218*a*. The secondary coupler 273 engages the elastomeric coupler 272 and the intermediate shaft 268.

Figure 13:
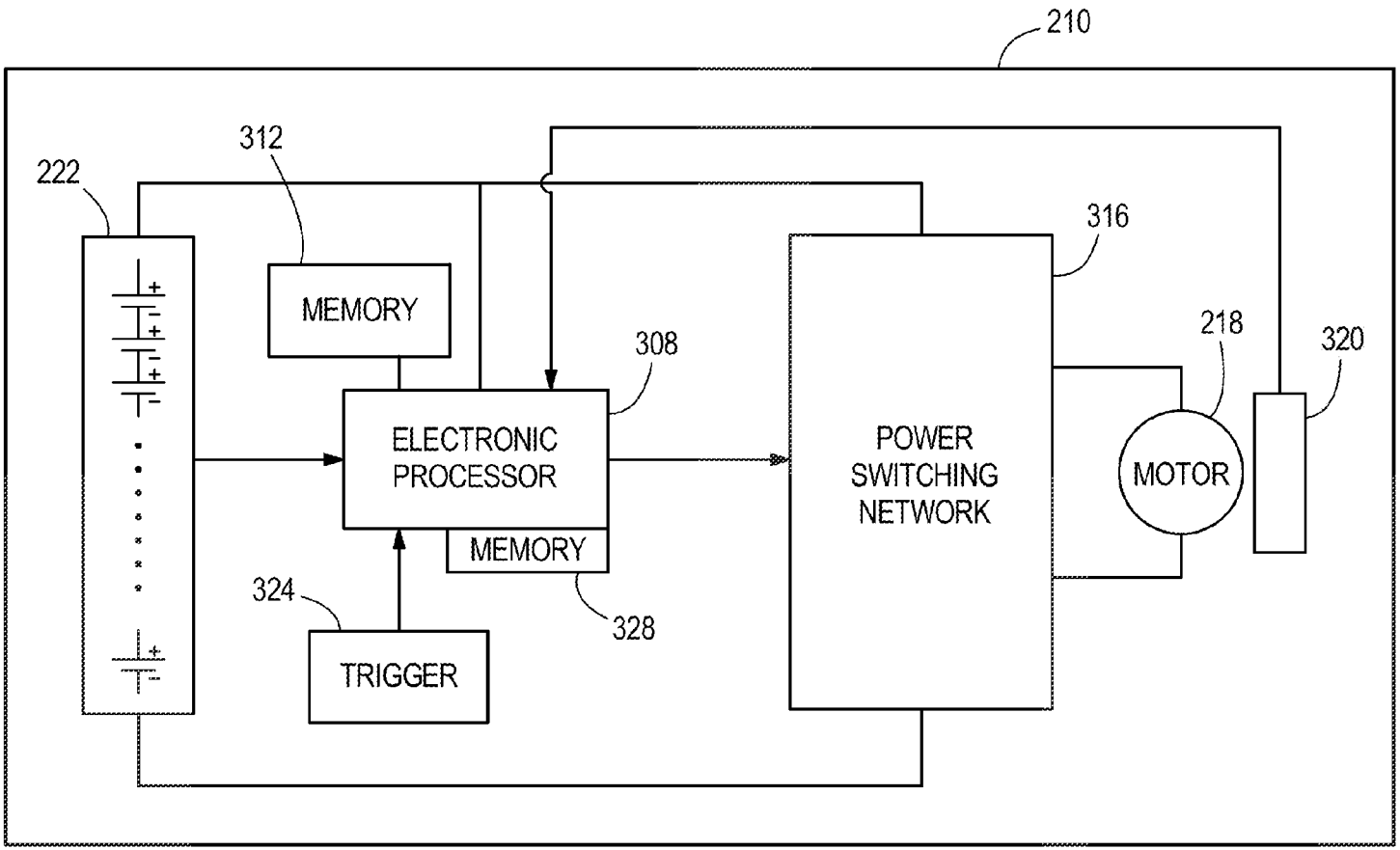
FIG. 13 is a simplified block diagram of the vibrating screed of FIG. 10.

FIG. 13 is a simplified block diagram of the vibrating screed 210 according to one example embodiment. In the example illustrated, the vibrating screed 210 includes an electronic processor 308, a memory 312, the battery pack 222, a power switching network 316 (including field-effect transistors or FETs), a rotor position sensor 320, and the trigger 324 (see FIG. 10 which illustrates the trigger 324 adjacent one of the handles 230). In some embodiments, the electronic processor 308 is implemented as a microprocessor with a separate memory (for example, memory 312). In other embodiments, the electronic processor 308 may be implemented as a microcontroller (with memory 328 on the same chip). In other embodiments, the electronic processor 308 may be implemented using multiple processors. In addition, the electronic processor 308 may be implemented partially or entirely as, for example, a field programmable gate array (FPGA), an application specific integrated circuit (ASIC), etc., and the memory 312 may not be needed or may be modified accordingly. The memory 312 stores instructions executed by the electronic processor 308 to carry out functions of the vibrating screed 210 described herein. The memory 312 includes read only memory (ROM), random access memory (RAM), other non-transitory computer-readable media, or a combination thereof.

The power switching network 316 enables the electronic processor 308 to control the operation of the motor 218. Generally, when the trigger 324 is depressed, electrical current is supplied from the battery pack 222 to the motor 218, via the power switching network 316. When the trigger 324 is not depressed, electrical current is not supplied from the battery pack 222 to the motor 218. In some embodiments, the amount in which the trigger 324 is depressed is related to or corresponds to a desired speed of rotation of the motor 218 (that is, closed loop speed control). In other embodiments, the amount in which the trigger 324 is depressed is related to or corresponds to a desired torque (that is, open loop speed control, or "direct drive").

In response to the electronic processor 308 receiving a drive request signal from the trigger 324, the electronic processor 308 activates the power switching network 316 to provide power to the motor 218. Through the power switching network 316, the electronic processor 308 controls the amount of current available to the motor 218 and thereby controls the speed and torque output of the motor 218. The power switching network 316 includes a plurality of FETs, for example, a six-FET bridge that receives pulse-width modulated (PWM) signals from the electronic processor 308.

The rotor position sensor 320 is coupled to the electronic processor 308. The rotor position sensor 320 includes, for example, a plurality of Hall-effect sensors, a quadrature encoder, or the like attached to the motor 18. The rotor position sensor 320 outputs motor feedback information to the electronic processor 308, such as an indication (e.g., a pulse) when a magnet of a rotor of the motor 218 rotates across the face of a Hall sensor. Based on the motor feedback information from the rotor position sensor 320, the electronic processor 308 can determine the position, velocity, and acceleration of the rotor 218*a*. In response to the motor feedback information and the signals from the trigger 324, the electronic processor 308 transmits control signals to control the power switching network 316 to drive the motor 18. For instance, by selectively enabling and disabling the FETs of the power switching network 316, power received from the battery pack 222 is selectively applied to the stator windings of the motor 218 in a cyclic manner to cause rotation of the rotor of the motor 18.

In some embodiments, the motor 218 is a sensorless motor that does not include the Hall-effect sensors. Removing the Hall-effect sensors provides the advantage of further reducing the size of the motor package. In these embodiments, the rotor position is detected based on the detecting the current, back electro-motive force (EMF), and/or the like in the inactive phases of the motor 218. Specifically, rather than the Hall sensors, current sensors, voltage sensors, or the like are provided outside the motor 18, for example, in the power switching network 316 or on a current path between the power switching network 316 and the motor 218. The permanent magnets of the rotor 218*a* generate a back EMF in the inactive phases as the rotor 218*a* moves past the stator phase coils. The electronic processor 308 detects the back EMF (e.g., using a voltage sensor) or the corresponding current (e.g., using a current sensor) generated in the inactive phase to determine the position of the rotor 218*a*. The motor 218 is then commutated similarly as described above based on the position information of the rotor 218*a*. Such a sensorless motor 218 may function without hall sensors acting as a quadrature encoder to output motor speed. Alternatively, constant power control circuitry may be used to minimize the impact in speed as the battery 222 state of charge diminishes. Such a sensorless motor 218 may include an initialization rotor alignment routine which is performed when starting the rotor 218*a* to determine the position of the rotor 218*a* before commutating.

The motor feedback information is used by the electronic processor 308 to ensure proper timing of control signals to the power switching network 316 and to provide closed-loop feedback to control the speed of the motor 218 to be at a desired level (i.e., at a constant speed). Specifically, the electronic processor 308 increases and decreases the duty ratio of the PWM signals provided to the power switching network 316 to maintain the speed of the motor 218 at a speed selected by the trigger 324. For example, as the load on the motor 218 increases, the speed of the motor 218 may decrease. The electronic processor 308 detects the decrease in speed using the rotor position sensor 320 or the back EMF sensors and proportionally increases the duty ratio of the PWM signals provided to the power switching network 316 (and thereby, the electrical power provided to the motor 218) to increase the speed back up to the selected speed. Similarly, when the load on the motor 218 decreases, the speed of the motor 218 may increase. The electronic processor 308 detects the increase in speed using the rotor position sensor 320 or the back EMF sensors and proportionally decreases the duty ratio of the PWM signals provided to the power switching network 316 (and thereby, the electrical power provided to the motor 218) to decrease the speed back down to the selected speed. Such operation of the electronic processor 308 may be continuous when the vibrating screed 210 is operated.

In open loop speed control, the electronic processor 308 maintains a constant duty ratio of the PWM signals (and thereby, constant electrical power provided to the motor 218) corresponding to the position of the trigger 324.

The electronic processor 308 is operable to receive the sensed position of the rotor 218*a* and to commutate the electric motor 18 according to the sensed position. Additionally, or alternatively, the electronic processor 308 is operable to receive the sensed speed of the rotor 218*a* and to adjust the amount of power provided to the electric motor 218 in the manner described above such that the motor 218 is driven at a desired speed. In the illustrated embodiment, the desired speed is a speed above 9,000 revolutions per minute. For example, the desired speed may be 10,000 revolutions per minute. As the speed of the electric motor 218 is maintained at the desired speed, a vibration frequency of the screed blade 214 is also maintained.

It is desired to maintain the vibration frequency of the screed blade 214 during operation of the vibrating screed 210. While passing the screed blade along wet concrete, it is important to vibrate the screed blade 214 at a speed high enough for proper concrete consolidation. If the speed of the motor 218 drops below a threshold, for example, 9,000 revolutions per minute, the concrete may not consolidate properly. Additionally, if the speed of the motor 218 rises above a threshold, for example, 15,000 revolutions per minute, the concrete may not consolidate properly. Thus, the integrity and appearance of the vibrated concrete will be negatively affected if the vibration frequency falls outside a threshold range.

By sensing the speed of the rotor 218*a* and commutating the electric motor 218 according to the sensed speed, the motor 218 can circumvent any speed discrepancies due to changes in the state of charge of the battery pack 222. As the vibrating screed 210 is used, the battery pack 222 state of charge becomes depleted. The electronic processor 308 is operable to receive sensed speed of the rotor 218*a* from the rotor position sensor 320 or the back EMF sensors and operate commutation of the motor 218 independent of the state of charge of the battery pack 222.

By utilizing the electronic processor 308 and rotor position sensor 320 of the BLDC motor 218, the vibrating screed 210 has numerous other advantages over other known vibrating screeds. The vibrating screed 210 is capable of operating at a higher efficiency when compared to known vibrating screeds. By commutating the motor 218 based on the sensed rotor 218*a* speed, mechanical drag and friction between components is eliminated. By commutating the motor 218 based on the sensed rotor 218*a* position, a constant phase advance can be optimized for relatively consistent loading of the tool. This is not possible with brushed DC electric motors. In brushed DC electric motors, brushes wear and the phase advance changes with the brush geometry. As such, the efficiency remains high because the brushless DC motor 218 phase advance is optimized and does not change throughout use.

Figure 14A:
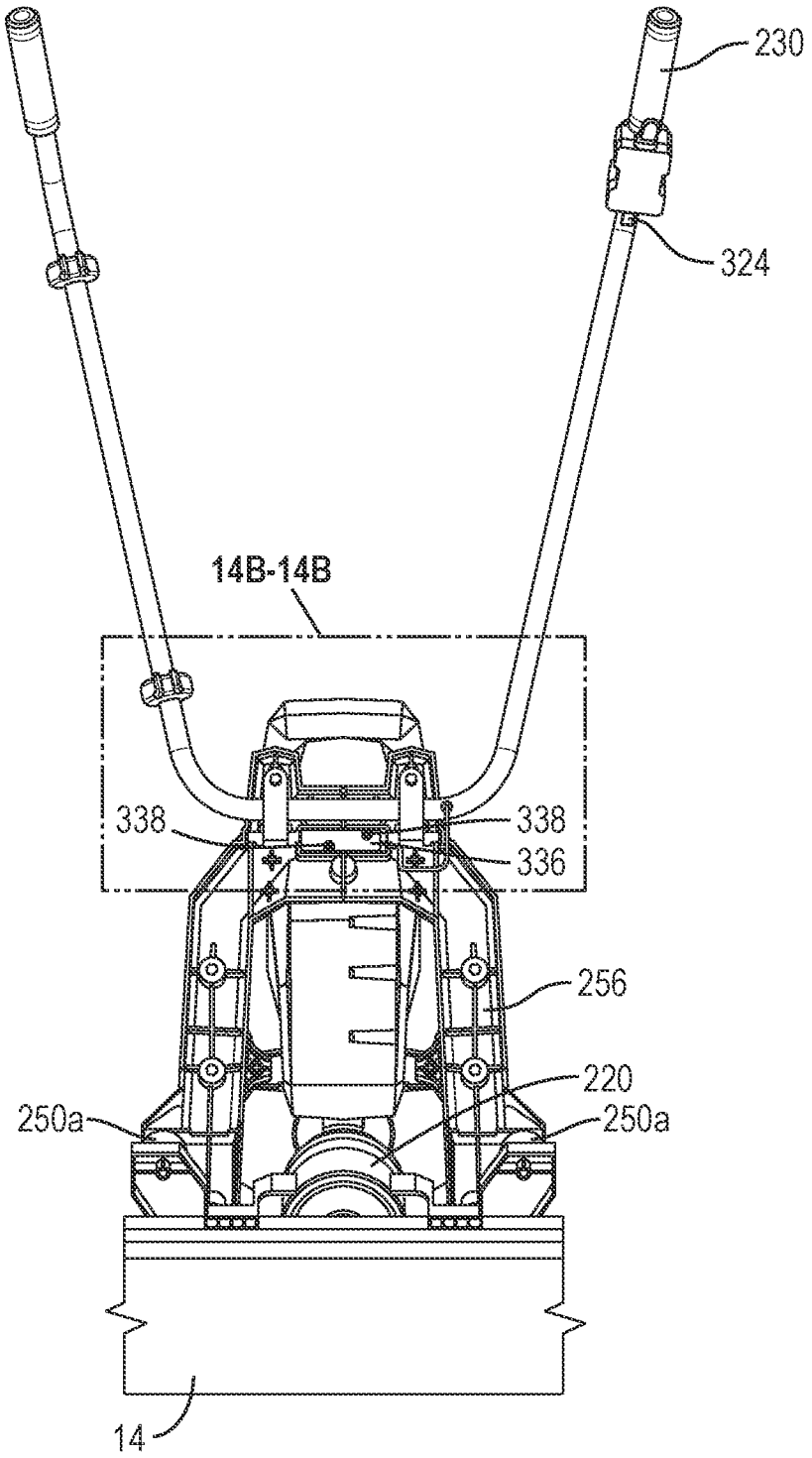
FIG. 14A is a rear perspective view of the vibrating screed of FIG. 10.
Figure 14B:
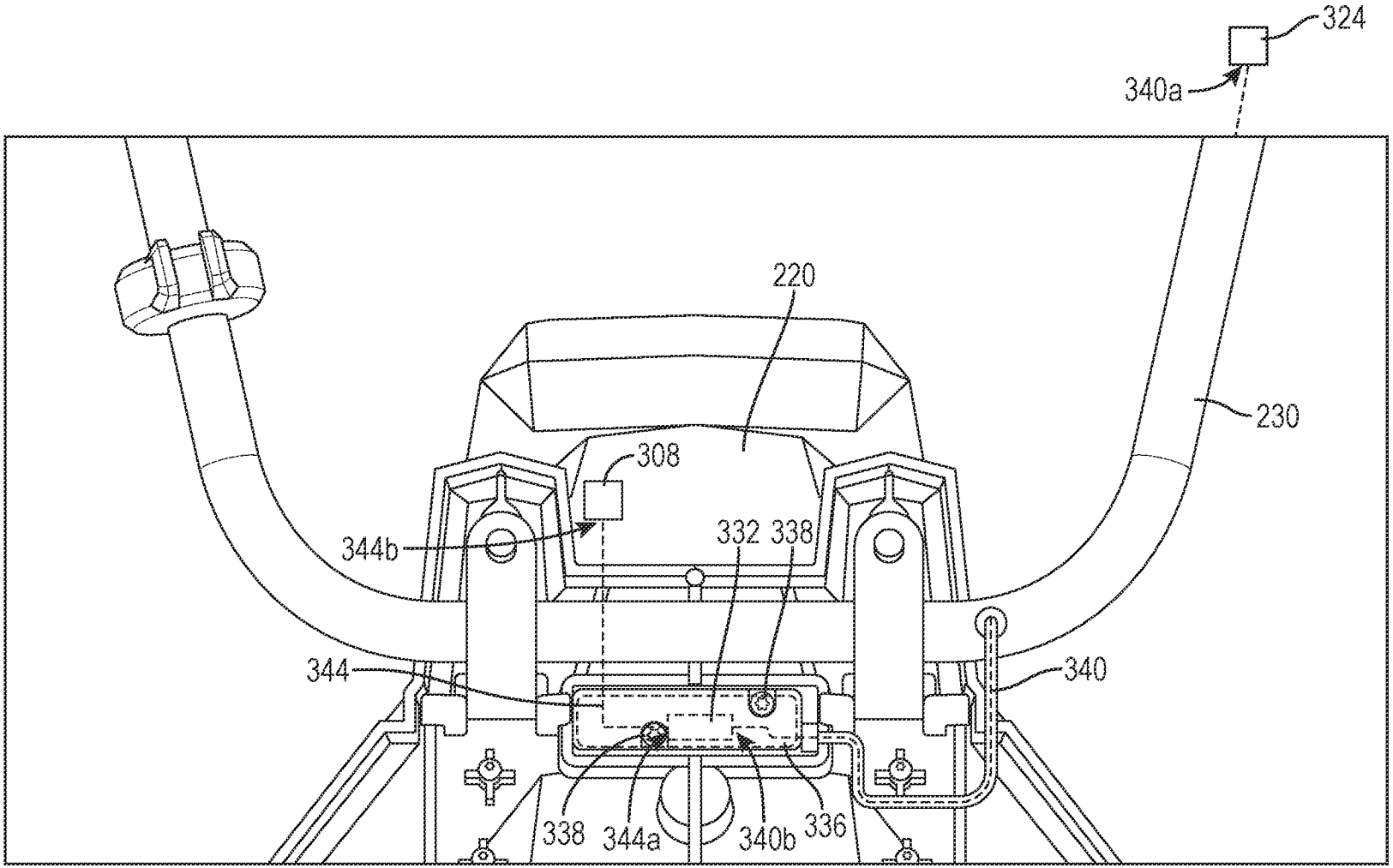
FIG. 14B is an enlarged view of the vibrating screed of FIG. 14A taken along section line 14B-14B in FIG. 14A.

FIGS. 14A and 14B illustrate a throttle assembly between the trigger 324 and the electronic processor 308. As explained in further detail below, the throttle assembly, when operated by a user of the vibrating screed, provides an input signal to the electronic processor 308 corresponding with a throttle input imparted to the trigger 324. As illustrated in FIG. 14B, the throttle assembly includes a wire connector 332 (including connected male and female electrical plugs) positioned within a connector housing 336. The connector housing 336 surrounds the connector 332 to inhibit ingress of undesired material (i.e., foreign bodies such as water, concrete, moisture, dust, dirt, etc.) from contacting the connector 332. In some embodiments, the connector housing 336 is constructed as an IP (i.e., Ingress Protection)-rated connector housing 336, which inhibits ingress of water, concrete, or other materials from entering the housing 336 and contacting the connector 332. The connector housing 336 may be removably secured to the motor housing 220 by one or more fasteners 338 (e.g., screws).

The throttle assembly also includes an external wire harness 340 extending between the trigger 324 and the connector 332. The external wire harness 340 has a first end 340*a* coupled to the trigger 324 and an opposite second end 340*b* coupled to the connector 332, with the second end 340*b* terminating in one of the male or female plugs of the wire connector 332. The second end 340*b* of the external wire harness 340 is positioned within the connector housing 336, with a portion of the external wire harness 340 protruding from the connector housing 336. Optionally, a portion of the external wire harness 340 extends through the handle 230.

The throttle assembly further includes an internal wire harness 344 having a first end 344*a* terminating in the other of the male or female plugs of the wire connector 332. The first end 344*a* of the internal wire harness 344 is also positioned within the connector housing 336. In some embodiments, the internal wire harness 344 protrudes from the connector housing 336 on route to the electronic processor 308. In other embodiments, the entirety of the internal wire harness 344 is positioned within a combination of the connector housing 336 and the motor housing 220. The internal wire harness 344 includes an opposite second end 344*b* coupled to the electronic processor 308 (via a printed circuit board and one or more electrical plugs).

Both the second end 340*b* of the external wire harness 340 and the first end 344*a* of the internal wire harness 344 are located within the connector housing 336 when the connector housing 336 is secured to the motor housing 220. In other words, the external wire harness 340 is electrically connected to the internal wire harness 344 by the connector 332 within the connector housing 336. As such, ingress of undesired material (e.g., water, concrete, moisture, dust, dirt, etc.) is inhibited from contacting the electrical connections within the connector 332.

Providing the wire connector 332 on the exterior of the vibrating screed 210 and surrounded by a connector housing 336 provides protection to and promotes ease of access for service to the wire connector 332. The connector housing 336 can be removed from the motor housing 220 by removing the fastener 338 and subsequently lifting the connector housing 336 away from the motor housing 220. This uncovers the wire connector 332 for service, permitting the first end 344*a* of the internal wire harness 344 to be disconnected from the second end 340*b* of the external wire harness 340. Therefore, the handle 230, external wire harness 340, and the trigger 324 can be collectively removed from the motor housing 220 as a unit for service independent of the housing 226, which stores the control electronics associated with the motor 218.

Figure 15:
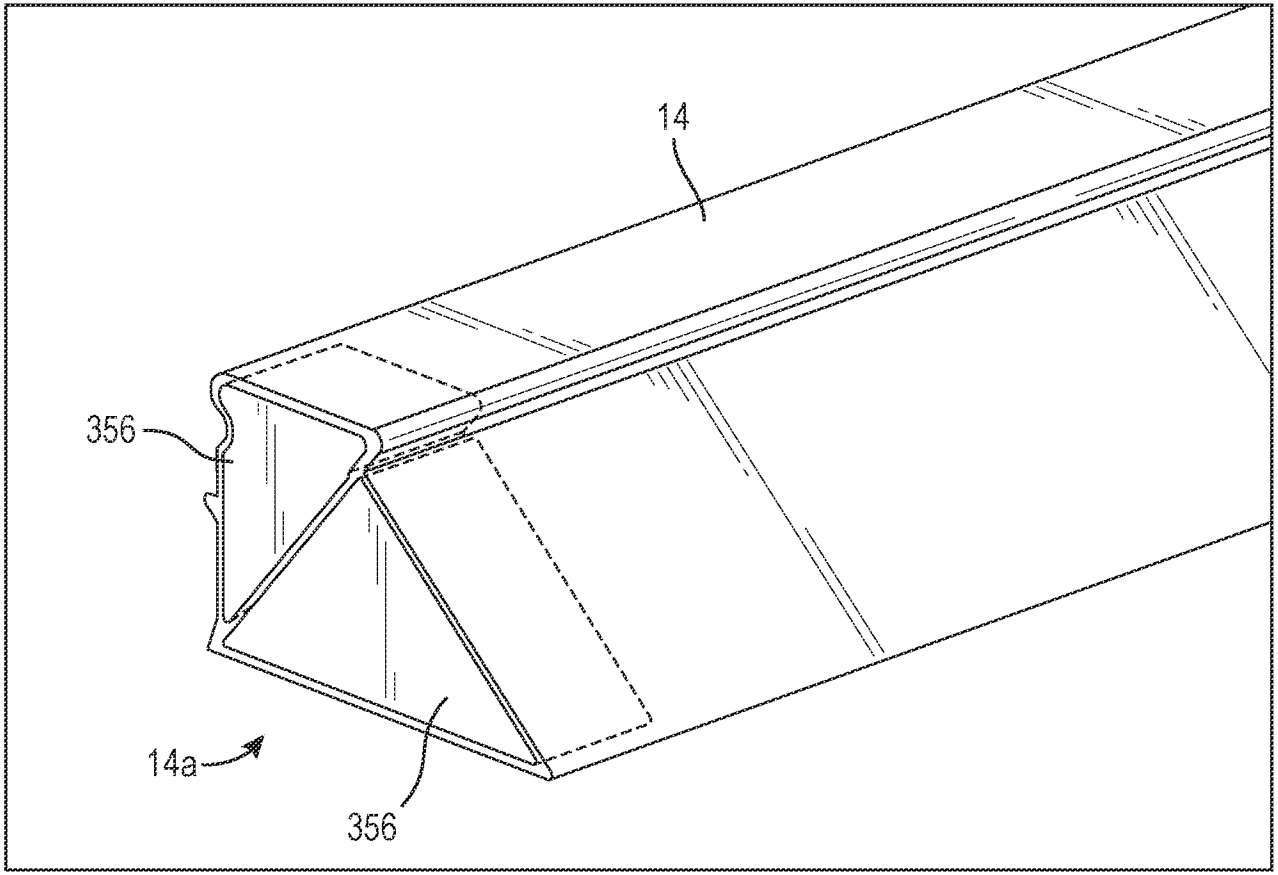
FIG. 15 is a perspective view of an alternate screed member, including a plug mass, for use with the vibrating screed of FIG. 10.

In some embodiments, the screed member 14 may include a plug mass 356 to alter the natural frequency of the screed member 14 (in absence of the plug mass 356). As shown in FIG. 15, the plug mass 356 is located adjacent an end 14*a* of the screed member 14. However, in other embodiments, the plug mass 356 may be located elsewhere along the length of the screed member 14. In some embodiments, the plug mass 356 is formed from a plastic, rubber, or metal material. In some embodiments, the plug mass 356 is an overmolded insert, which may be installed into at least one end 14*a* of the screed member 14. In some embodiments, the plug mass 356 is installed at both ends 14*a* of the screed member 14. In some embodiments, the plug mass 356 may be removable from the screed member 14 and repositionable to a different location along the length of the screed member 14. Further, plug masses 356 made of a first material may be removed from the screed member 14 and replaced with plug masses 356 made of a second material different than the first material. In other embodiments, the plug mass 356 may be fixed to the screed member 14.

The screed member 14 itself may define a screed natural frequency based on the geometry and material properties of the screed member 14. In some embodiments, the screed member 14 may be made of extruded Aluminum or Magnesium. In some embodiments, the screed member 14 may be made of a single piece of metal. In some embodiments, the screed member 14 may have a wall thickness (as a result of being hollow). Material properties and geometry of the screed member 14 contribute to the screed member 14 having the screed natural frequency of vibration.

Dependent on the material and geometry of the screed member 14 as well as the operation of the motor 218, the screed natural frequency may be close to the frequency of vibration emitted by the exciter assembly 54, 234 (i.e., the exciter frequency). The exciter frequency may correspond generally with a rotational speed of the motor 218 (e.g., 9,000 rpm [150 Hz] and/or 15,000 rpm [250 Hz]). When the screed natural frequency and the exciter frequency become too close, undesired resonance might occur which, in some cases, damage the motor 218 and/or other components of the vibrating screed 210.

Including the plug mass 356 in the screed member 14 may adjust the screed natural frequency of the combined screed member 14 plug mass 356 to be unequal to the exciter frequency to avoid resonance and any resultant damage to the motor 218. In other words, the natural frequency of the combined screed member 14/plug mass 356 is further from the frequency of vibration emitted by the exciter assembly 54, 234 than the natural frequency of the screed member 14 alone.

Figure 16:
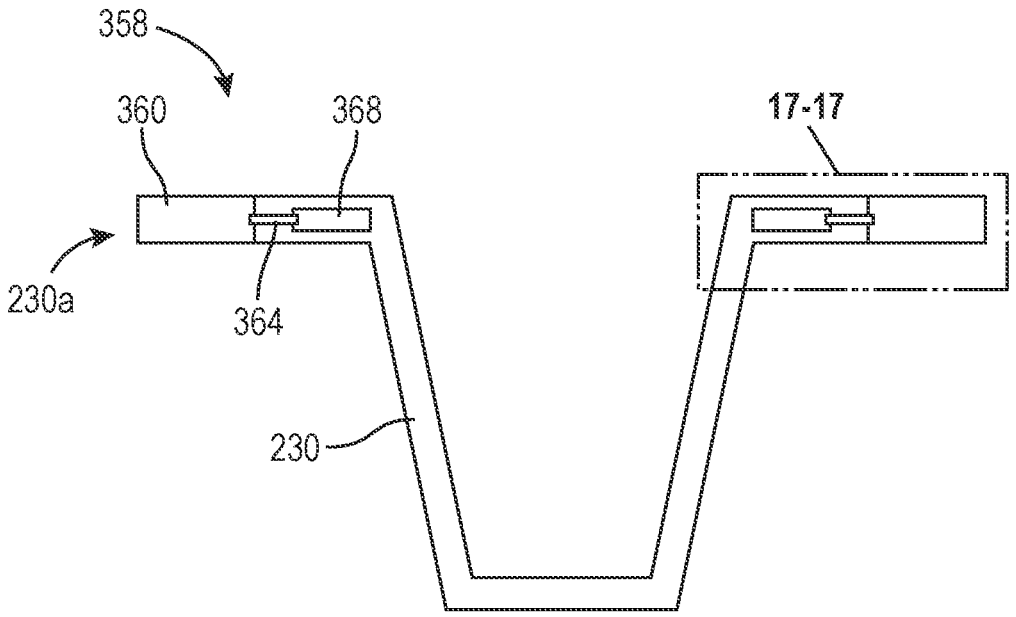
FIG. 16 is a schematic view of a tuned mass system within the handle of the vibrating screed of FIGS. 1 of 10.
Figure 17:
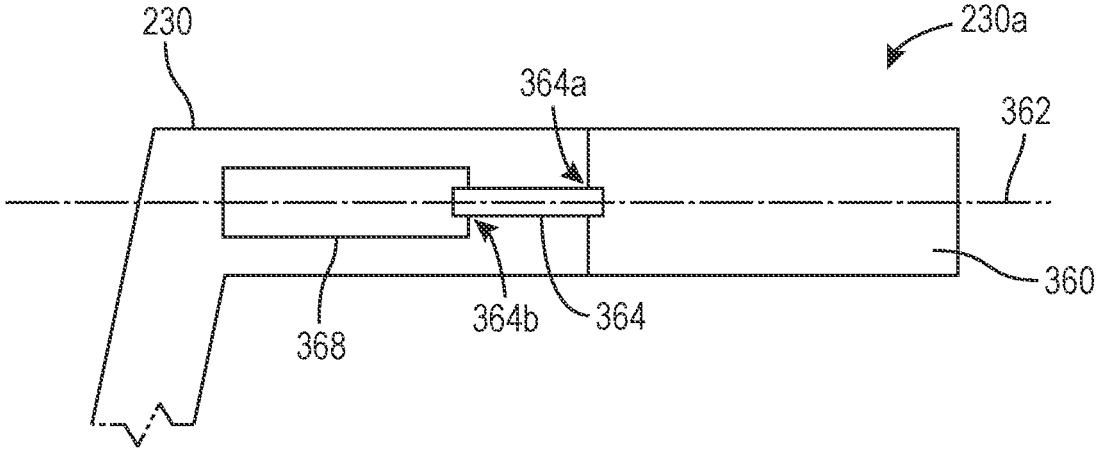
FIG. 17 is an enlarged schematic view of the tuned mass system of FIG. 16 taken along section line 17-17 in FIG. 16.

FIGS. 16 and 17 illustrate a tuned mass system 358 coupled to the handle 230. The tuned mass system 358 may include an end cap 360, a spring member 364, and a tuned mass 368. The end cap 360 may be provided adjacent an end 230*a* of the handle 230. In the illustrated embodiment, the end cap 360 may extend to the end 230*a*. However, the end cap 360 may otherwise be provided adjacent the end 230*a*. The spring member 364 may have a first end 364*a* coupled to the end cap 360. The spring member 364 may have an opposite second end 364*b* coupled to the tuned mass 368. In the illustrated embodiment, as best shown in FIG. 17, the spring member 364 may be a coil spring. However, in other embodiments, the spring member 364 may be another elastically deformable member. In some embodiments, the spring member 364 may be made, for example, of an elastomer or a spring steel. The end cap 360 may be aligned along a cap axis 362. In some embodiments, the cap axis 362 may extend through the center of the end cap 360. In some embodiments, the cap axis 362 is coaxial with the handle 302. The end cap 360 may be sufficiently fixed to the handle 230 to not deflect with respect to the handle 230. The spring member 364 may be sufficiently elastically deformable such that the tuned mass 368 may become misaligned with the cap axis 362 upon vibration of the handle 230. The tuned mass 368 can attenuate vibration generated by the vibrating screed 210. The tuned mass 368 may move within the handle 230 in order to substantially attenuate vibration of the handlebars 230.

A user operating the vibrating screed 210 may hold the handle 230 adjacent the tuned mass system 358. This may limit the amount of vibration transmitted to the user through the handle 230 during operation.

FIGS. 18 through 23 illustrate quick-release clamp assemblies 372, 376, 380 for selectively retaining the screed member 14, 214 to the exciter housing 238. Each clamp assembly 372, 376, 380 may be movable between a disengaged position 372*a*, 376*a*, 380*a*, respectively, and an engaged position 372*b*, 376*b*, 380*b*. Each assembly may include an edge clamp 384 which may be coupled to a latch 388 by a connection mechanism 392. As such, the latch 388 may be pivoted along an arrow, A1, between the respective disengaged position 372*a*, 376*a*, 380*a*, and the respective engaged position 372*b*, 376*b*, 380*b*. Each clamp assembly 372, 376, 380, while in the engaged position 372*b*, 376*b*, 380*b*, may be configured to secure the screed member 14 to the exciter housing 238 (and thus, the exciter assembly 234) to transmit vibration generated by the exciter assembly 234 to the screed member 14. In the engaged position 372*b*, 376*b*, 380*b* of each clamp assembly 372, 376, 380, the edge clamp 384 may be wedged against the screed member 14. In the disengaged position 372*a*, 376*a*, 380*a* of each clamp assembly 372, 376, 380, the edge clamp 384 releases the screed member 14 from the exciter housing 238, permitting the screed member 14 to be removed and replaced with another screed member 14.

Figure 18:
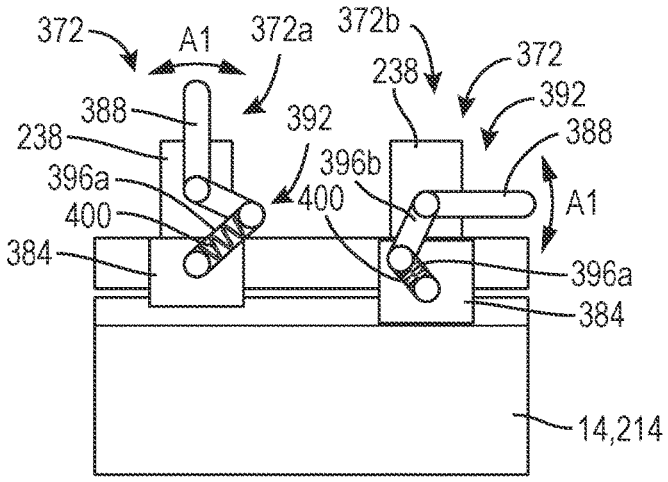
FIG. 18 is a front view of a first clamp assembly configured to secure a screed member to an exciter assembly in either of the vibrating screeds of FIG. 1 or 10.

FIG. 18 illustrates both the disengaged position 372*a* and the engaged position 372*b* of the clamp assembly 372. In the clamp assembly 372, the connection mechanism 392 may include a two-bar linkage 396. The two-bar linkage 396 may include a first bar 396*a* and a second bar 396*b*. The first bar 396*a* may be coupled to the edge clamp 384. The second bar 396*b* may include a first end coupled to the first bar 396*a* and an opposite second end coupled to the latch 388. In some embodiments, at least one of the first bar 396*a* and the second bar 396*b* may be adjustable in length. In the illustrated embodiment, the first bar 396*a* may be adjustable in length, and the first bar 396*a* may be provided with a spring 400. When the latch 388 is rotated along the arrow A1 towards the engaged position 372*b*, the spring 400 may be compressed to translate the edge clamp 384 towards the screed member 14. Upon full rotation of the latch 388 to the engaged position 372*b*, the edge clamp 384 may be wedged against the screed member 14. In the engaged position 372*b*, the spring 400 may bias the edge clamp 384 such that the screed member 14 may be secured to the exciter housing 238.

Figure 19:
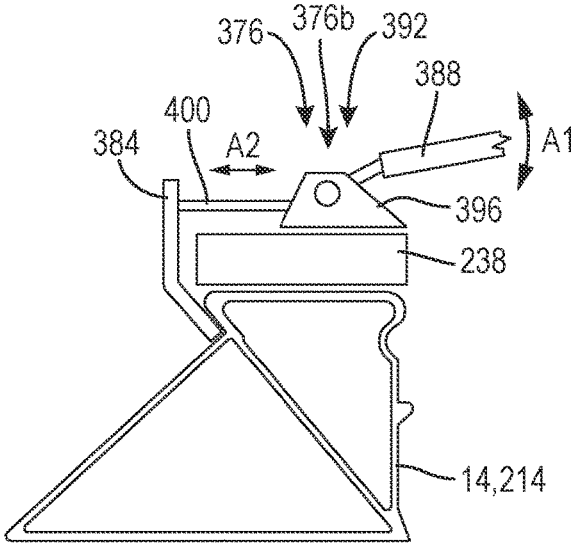
FIG. 19 is a side view of a second clamp assembly in an engaged position in which the second clamp assembly secures a screed member to an exciter assembly in either of the vibrating screeds of FIG. 1 or 10.
Figure 20:
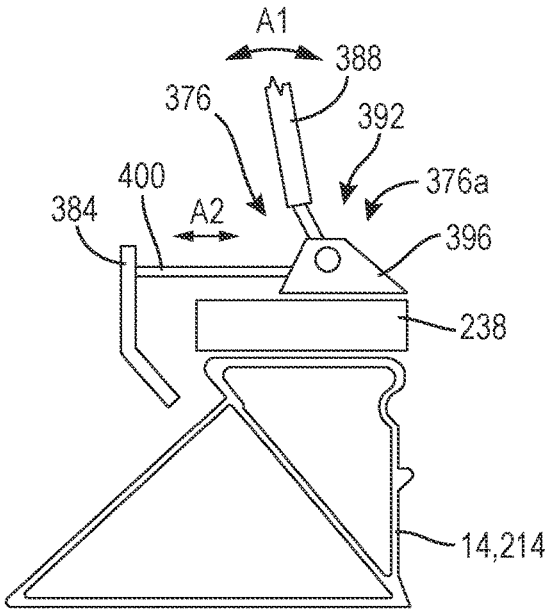
FIG. 20 is a side view of the second clamp assembly of FIG. 19 in a disengaged position in which the screed member is removeable from the first clamp assembly.

FIGS. 19 and 20 illustrate, respectively, the disengaged position 376*a* and the engaged position 376*b* of the clamp assembly 376. In the clamp assembly 376, the connection mechanism 392 may include a toggle clamp 396 and a connecting rod 400. The connecting rod 400 may include a first end coupled to the edge clamp 384 and an opposite, second end coupled to the toggle clamp 396. The latch 388 may be rotatable along the arrow A1 to pivot the toggle clamp 396. Upon pivoting of the toggle clamp 396, the connecting rod 400 may be translated along an arrow A2 to extend and retract the edge clamp 384 between the disengaged position 376*a* and the engaged position 376*b*. In some embodiments, the connecting rod 400 may have an adjustable length to allow a user to adjust the pretension on the screed member 14 when in the engaged position 376*b*. In embodiments with an adjustable length connecting rod 400, the adjustable connecting rod 400 may mitigate the need for replacement of the clamp assembly 376 and/or the screed member 14 due to interface wear by providing means to adjust the pre-tension.

Figure 21:
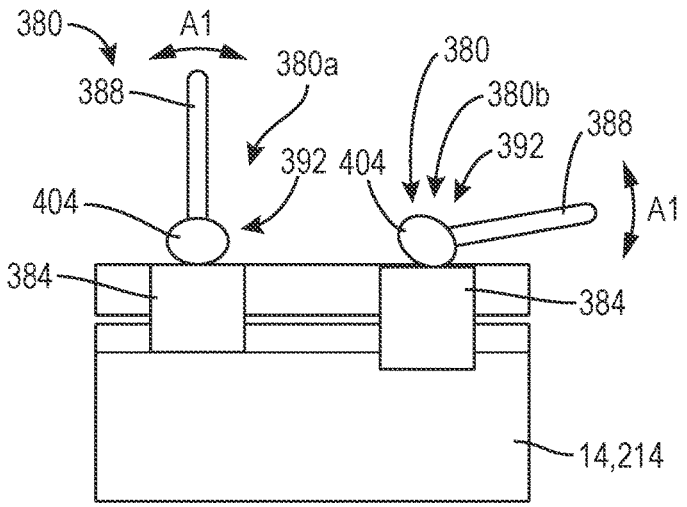
FIG. 21 is a schematic view of a third clamp assembly configured to secure a screed member to an exciter assembly in either of the vibrating screeds of FIG. 1 or 10.
Figure 22:
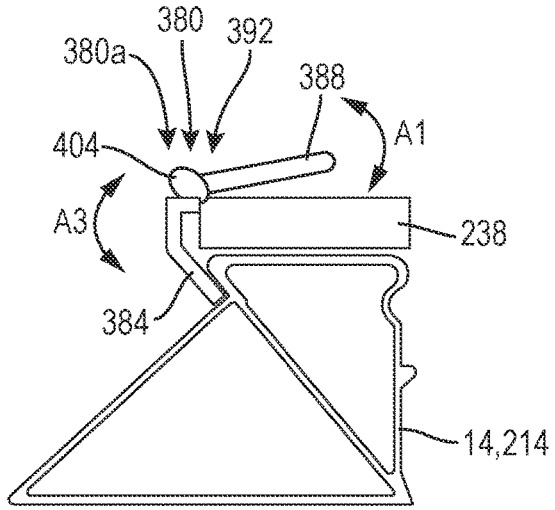
FIG. 22 is a side view of the third clamp assembly of FIG. 21 in an engaged position in which the third clamp assembly secures the screed member to the exciter assembly.
Figure 23:
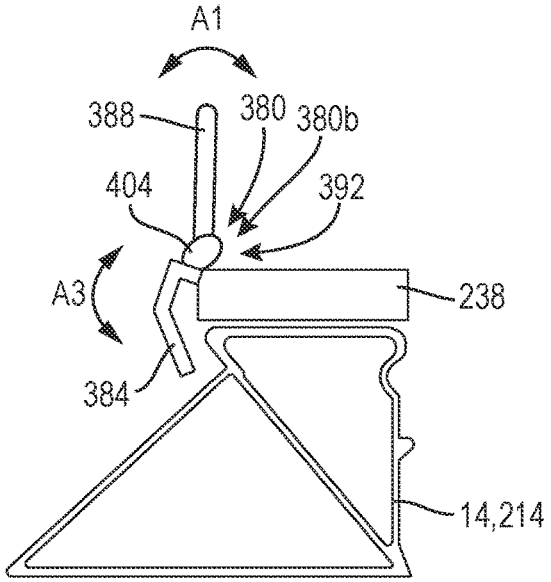
FIG. 23 is a side view of the third clamp assembly of FIG. 21 in a disengaged position in which the screed member is removeable from the third clamp assembly.

FIGS. 21-23 illustrate the clamp assembly 380. The clamp assembly 380 is illustrated in the engaged position 380*a* in FIGS. 21 and 22. The clamp assembly 380 is illustrated in the disengaged position 380*b* in FIGS. 21 and 23. As illustrated in FIG. 21, the vibrating screed 210 may include two clamp assemblies 380 spaced along the length of the screed member 14. In the clamp assembly 380, the connection mechanism 392 may be provided as a cam 404 at an end of the latch 388. When in the engaged position 380*a*, contact between the cam 404 and the edge clamp 384 provides adequate contact force to secure the screed member 14 to the exciter housing 238. The contact surface between the cam 404 and the edge clamp 384 provides a large mechanical advantage. In some embodiments, the edge clamp 384 may be spring biased to allow the edge clamp 384 to automatically open when the clamp assembly 380 is in the disengaged position 380*b*. In transitioning between the engaged position 380*a* and the disengaged position 380*b*, the latch 388 may be pivoted along the arrow A1 and the cam 404 may cause the edge clamp 384 to pivot along the arrow A3.

Figure 24:
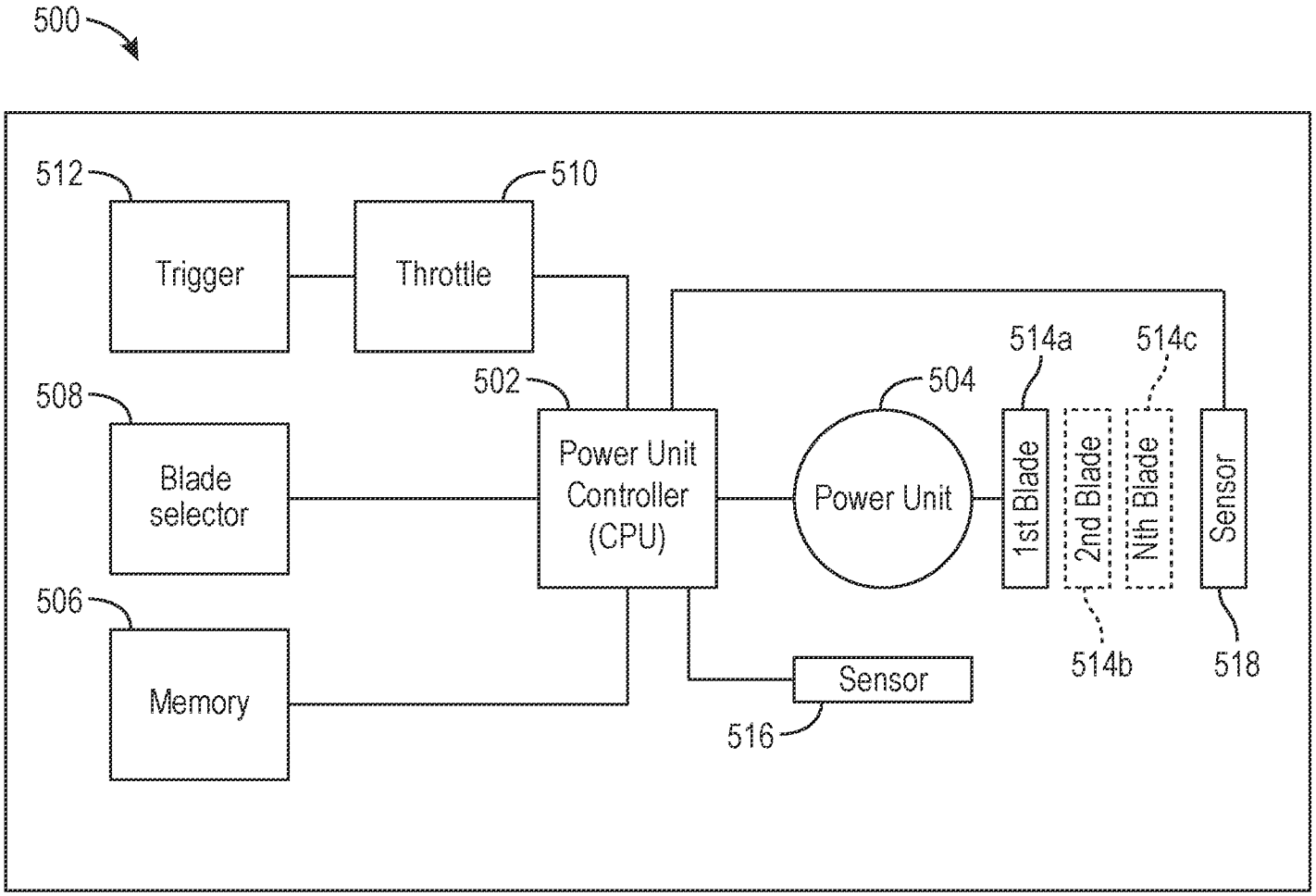
FIG. 24 is a simplified block diagram of a vibrating screed according to another embodiment.

Referring now to FIG. 24, a block diagram of another vibrating screed 500 is illustrated. In addition to what is shown in FIG. 24, the vibrating screed 500 may include one or more of the features or components illustrated in FIG. 13. As shown in FIG. 24, the vibrating screed 500 includes a power unit controller 502. The power unit controller 502 can be a central processing unit (CPU) or a microprocessor. Further, the power unit controller 502 can be a motor controller or an engine controller. The power unit controller 502 is operably connected to a power unit 504, a memory 506, a blade selector 508, and a throttle 510. In a particular embodiment, the power unit 504 includes an electric motor that may receive power from a direct current (DC) source, e.g., a battery, or from an alternating current (AC) source and an exciter assembly (e.g., exciter assembly 234) that receives torque from the motor to emit vibration as described above. In another embodiment, the power unit 504 may include a combustion engine that derives power from burning a fossil fuel such as gasoline, diesel fuel, propane, or natural gas.

As depicted in FIG. 24, a trigger 512 is operably coupled to the throttle 510. A first screed blade 514*a*, a second screed blade 514*b*, or an Nth screed blade 514*c* is operably coupled to the power unit 504. It is to be understood that each screed blade 514*a*, 514*b*, 514*c* is removably engaged with the power unit 504 and only a single screed blade 514*a*, 514*b*, 514*c* may be engaged with the power unit 504 at a time. FIG. 24 also indicates that the vibrating screed 500 includes a first speed sensor 516 associated with the power unit 504 in order to detect the rotational speed of the power unit 504. In some embodiments, the first speed sensor 516 may be integrated with the power unit 504 and may be configured as, for example, a Hall-effect sensor or sensory array for detecting a rotational speed of an electric motor. Moreover, in some embodiments, the vibrating screed 500 may include a second speed sensor 518 (e.g., a vibration transducer or accelerometer) adjacent to the screed blade 514*a*, 514*b*, 514*c* in order to detect the oscillating (back-and-forth) speed, or frequency, of the screed blade 514*a*, 514*b*, 514*c*.

The blade selector 508 allows a user to select a size of the screed blade 514*a*, 514*b*, 514*c* that is engaged with the power unit 504. Depending on the current application, screed blades 514*a*, 514*b*, 514*c* having different sizes (e.g., lengths and weights) may be removably engaged with the power unit 504. For example, finishing a concrete sidewalk may require a much smaller screed blade 514*a*, 514*b*, 514*c* than finishing a concrete pad for a six-car garage. As such, the screed blades 514*a*, 514*b*, 514*c* may range in length from four feet to sixteen feet (4 ft-16 ft). After engaging a particular screed blade 514*a*, 514*b*, 514*c* with the power unit 504, the user may use the blade selector 508 to select a size that corresponds to the screed blade 514*a*, 514*b*, 514*c* that is engaged with the power unit 504. As described in detail below, the size of the screed blade 514*a*, 514*b*, 514*c* determines the operational speed range of the power unit 504.

During operation, as described in greater detail below, a user selects a blade size associated with the screed blade 514*a*, 514*b*, 514*c* that is coupled to the power unit 504. Based on the blade size, the power unit controller 502 sets the throttle 510 to operate within a range of speeds associated with the selected size of the screed blade 514*a*, 514*b*, 514*c*. The speed range for each screed blade 514*a*, 514*b*, 514*c* is based on the natural frequency of the screed blade 514*a*, 514*b*, 514*c*. The optimal vibration of the screed blade 514*a*, 514*b*, 514*c* is determined by the proximity of the frequency of vibration emitted by the power unit 504 to the natural frequency of the screed blade 514*a*, 514*b*, 514*c*. If the power unit 504 is exciting the screed blade 514*a*, 514*b*, 514*c* at its natural frequency, the power unit 504 is operating at a "critical speed" associated with the screed blades 514*a*, 514*b*, 514*c*. However, operating at the natural frequency of the screed blade 514*a*, 514*b*, 514*c* can cause the performance of the vibrating screed 500 to degrade. As such, exciting each selected screed blade 514*a*, 514*b*, 514*c* at its natural frequency is avoided.

The natural frequency of each screed blade 514*a*, 514*b*, 514*c* depends at least partially on the stiffness of the screed blade 514*a*, 514*b*, 514*c* and the mass of the screed blade 514*a*, 514*b*, 514*c*. And, the stiffness of the screed blade 514*a*, 514*b*, 514*c* depends at least partially on the length of the screed blade 514*a*, 514*b*, 514*c*, the cross-sectional area (moment of inertia) of the screed blade 514*a*, 514*b*, 514*c*, and the material from which the screed blade 514*a*, 514*b*, 514*c* is constructed. The mass of the screed blade 514*a*, 514*b*, 514*c* depends on the length of the screed blade 514*a*, 514*b*, 514*c*, the volume of the screed blade 514*a*, 514*b*, 514*c*, and the material from which the screed blade 514*a*, 514*b*, 514*c* is constructed.

The desired or acceptable excitation frequencies associated with each particular screed blade 514*a*, 514*b*, 514*c* may be stored within the memory 506. When the user actuates, or otherwise depresses, the trigger 512, the throttle 510 is adjusted to cause the power unit 504 to operate within the range of speeds associated with the selected screed blade 514*a*, 514*b*, 514*c* that avoid the natural frequencies of the respective screed blades 514*a*, 514*b*, 514*c*. While the power unit 504 operates, the power unit controller 502 uses input from the first speed sensor 516 to sense the speed of the power unit 504 and the optional second speed sensor 518 to sense the vibrating frequency of the screed blade 514*a*, 514*b*, 514*c*. Based on these inputs, the power unit controller 502 modifies the speed of the power unit 504 and to ensure that the power unit 504 does not operate at or near the critical speeds associated with the natural frequencies of the screed blades 514*a*, 514*b*, 514*c*, which could degrade performance of the vibrating screed 500.

Figure 25:
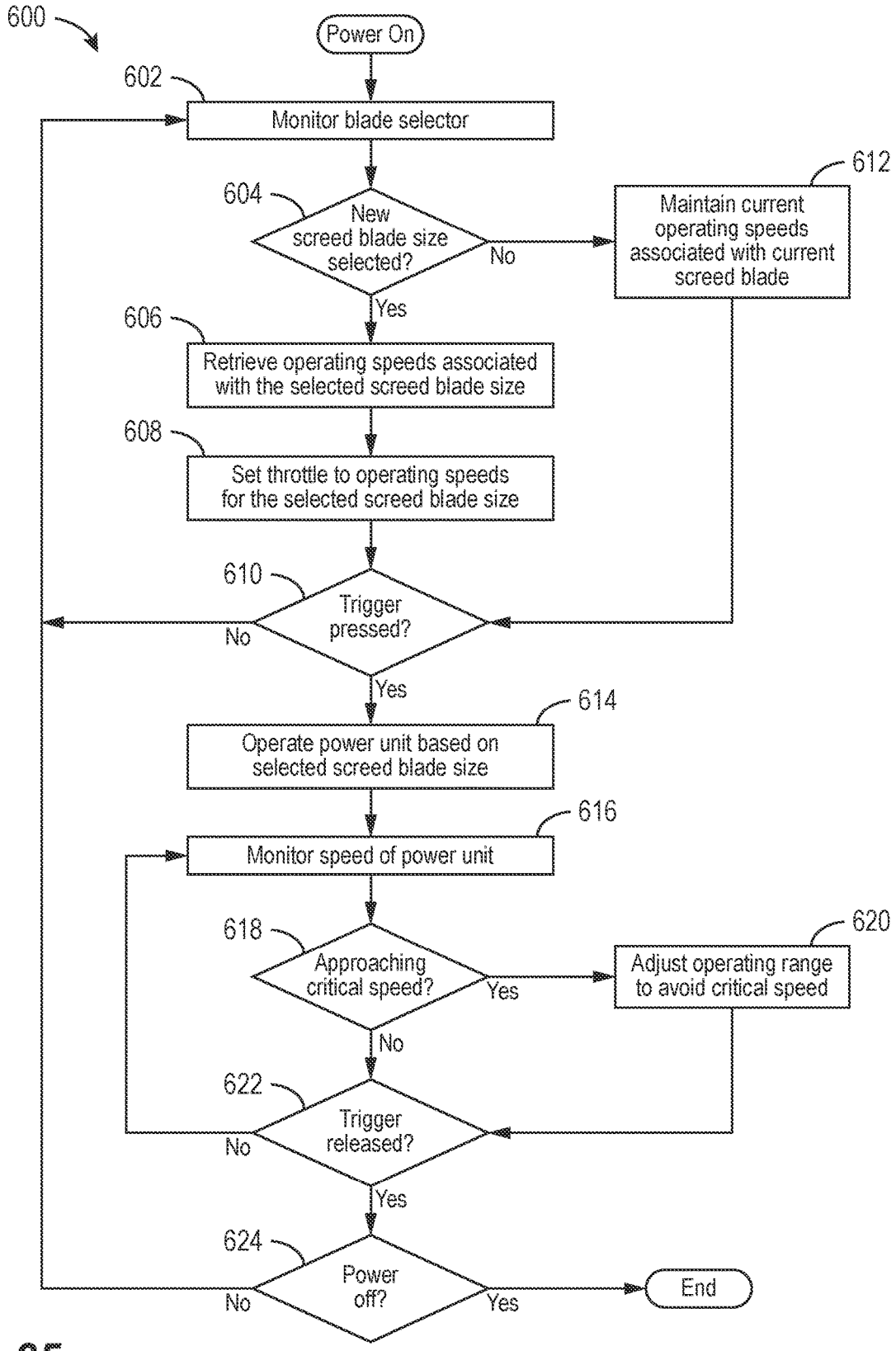
FIG. 25 is flowchart illustrating a method of operation of the vibrating screed of FIG. 24.

FIG. 25 depicts a flowchart that illustrates a method of operating a vibrating screed that is generally designated 600. Beginning at block 602, when the power is on, the method 600 monitors a blade selector. At decision 604, the method 600 determines whether a new screed blade size is selected. If a new screed blade size is selected, the method 600 proceeds to block 606 and the method 600 retrieves one or more operating speeds associated with the selected screed blade size. Moreover, at block 608, the method 600 sets the throttle to the operating speeds, i.e., the operating range, for the selected screed blade size. Thereafter, the method 600 continues to decision 610. Returning to decision 604, if the method 600 determines that a new screed blade size is not selected, the method 600 proceeds to block 612. At block 612, the method 600 maintains the current operating speeds associated with current screed blade. Then, the method 600 moves to decision 610.

At decision 610, the method 600 determines whether the trigger 512 is pressed. If the trigger is not pressed, or otherwise actuated, the method 600 returns to block 602 and continues as described herein. Conversely, if the trigger 512 is pressed, the method 600 moves to block 614 wherein the method 600 operates the power unit 504 on selected screed blade size. Next, at block 616, the method 600 monitors the speed of the power unit 504, the vibrating frequency of the blade, or a combination thereof. Proceeding to decision 618, the method 600 determines whether the speed of the power unit 504 is approaching a critical speed, i.e., the natural frequency of the screed blade 514*a*, 514*b*, 514*c*. If so, the method 600 moves to block 620 and adjusts the operating range to avoid the critical speed. Thereafter, the method 600 moves to decision 622. Returning to decision 618, if the speed of the screed blade is not approaching a critical speed, the method 600 proceeds directly to decision 622.

At decision 622, the method 600 determines whether the trigger 512 is released. If not, the method 600 returns to block 616 and continues to monitor the speed of the power unit 504 and the blade before continuing as described herein. Otherwise, at decision 622, if the trigger is released, the method 600 proceeds to decision 624. At decision 624, the method 600 determines whether the vibrating screed 500 is powered off. If the vibrating screed 500 is powered off, the method 600 ends. On the other hand, if the vibrating screed 500 remains powered on, the method 600 may return to block 602 and the method 600 may continue as described herein.

Unlike traditional vibrating screeds that allow only a limited amount of user input for the vibration that is delivered to the concrete, the system and method described above provides a user the ability to adjust the amount of vibration that is delivered to the concrete. This is accomplished by providing the user the ability to choose a particular screed with associated speeds via the blade selected. This allows the user much more control of the concrete finishing process by allowing the user to select a particular screed blade length and allowing the system, e.g., the vibrating screed, to adjust the speed of the vibrating screed based on the selected screed blade length. As such, a predetermined speed range that is unique to each selectable screed blade is provided for during the operation of the vibrating screed 500. The power unit controller 502 uses the sensors 516, 518 to avoid critical speeds which negatively affect the user experience with the vibrating screed 500. These negative experiences can include increased vibration from the vibrating screed 500, poor surface finish of the concrete on which the vibrating screed 500 is being used, and increased power consumption for the power unit 504 of the vibrating screed 500.

Although the invention has been described in detail with reference to certain preferred embodiments, variations and modifications exist within the scope and spirit of one or more independent aspects of the invention as described.

Various features of the invention are set forth in the following claims.

What is claimed is:

1. A vibrating screed comprising:
- a power unit;
- a plurality of screed blades, wherein each of the plurality of screed blades is removably engageable with the power unit one at a time;
- a power unit controller operably coupled to the power unit;
- a memory operably coupled to the power unit controller; and
- a blade selector operably coupled to the power unit controller, wherein the power unit controller is operable to:
  - receive a blade selection from the blade selector, the blade selection indicating a size of a selected screed blade within the plurality of screed blades;
  - retrieve a range of operating speeds associated with the blade selection; and
  - set an operational speed of the vibrating screed to correspond to the range of operating speeds associated with the blade selection.

2. The vibrating screed of claim 1, further comprising a plurality of acceptable excitation frequencies stored in the memory and associated with each of the plurality of screed blades.

3. The vibrating screed of claim 1, further comprising a first speed sensor to detect a rotational speed of the power unit.

4. The vibrating screed of claim 3, further comprising a second speed sensor to detect vibrating frequency of the selected screed blade engaged with the power unit.

5. The vibrating screed of claim 4, wherein the power unit controller is further operable to receive inputs from the first speed sensor and the second speed sensor.

6. The vibrating screed of claim 1, wherein, with input received from a sensor, the power unit controller is further operable to determine a vibrating frequency of the selected screed blade.

7. The vibrating screed of claim 6, wherein the power unit controller is further operable to modify a speed of the power unit to prevent the power unit from operating at a critical speed associated with a natural frequency of the selected screed blade.

8. A vibrating screed comprising:
- a power unit;
- a plurality of screed blades, wherein each of the plurality of screed blades is removably engageable with the power unit one at a time; and
- a power unit controller operably coupled to the power unit, wherein the power unit controller is operable to:
  - monitor a blade selector for a selected screed blade size;
  - retrieve one or more operating speeds associated with the selected screed blade size; and
  - set a throttle coupled to the power unit to the one or more operating speeds associated with the selected screed blade size.

9. The vibrating screed of claim 8, further comprising a trigger configured to selectively activate the power unit, wherein the power unit controller is further operable to determine when the trigger is pressed.

10. The vibrating screed of claim 9, wherein the power unit controller is further operable to operate the power unit based on the selected screed blade size when the trigger is pressed.

11. The vibrating screed of claim 10, wherein the power unit controller is further operable to monitor a speed of the power unit.

12. The vibrating screed of claim 11, wherein the power unit controller is further operable to determine when the speed of the power unit is approaching a critical speed associated with a natural frequency of the selected screed blade engaged with the power unit.

13. The vibrating screed of claim 12, wherein the power unit controller is further operable to adjust the speed of the power unit to avoid the critical speed.

14. A method of operating a vibrating screed, the method comprising:
- receiving, by a power unit controller, a selected screed blade size from a blade selector;
- retrieving, by the power unit controller, a range of operating speeds associated with the selected screed blade size from a memory operably coupled to the power unit controller; and
- setting, by the power unit controller, an operational speed of the vibrating screed to correspond to the range of operating speeds associated with the selected screed blade size.

15. The method of claim 14, wherein the selected screed blade size indicates a size of a particular screed blade.

16. The method of claim 14, further comprising determining, by the power unit controller, when a trigger of the vibrating screed is pressed.

17. The method of claim 16, further comprising operating, by the power unit controller, a power unit of the vibrating screed based on the selected screed blade size when the trigger is pressed.

18. The method of claim 17, further comprising monitoring, by the power unit controller, a speed of the power unit.

19. The method of claim 18, further comprising determining, by the power unit controller, when the speed of the power unit is approaching a critical speed associated with a natural frequency of the selected screed blade engaged with the power unit.

20. The method of claim 19, further comprising adjusting, by the power unit controller, the speed of the power unit to avoid the critical speed.

* * * * *